US010790577B2

(12) United States Patent
Wigdahl et al.

(10) Patent No.: US 10,790,577 B2
(45) Date of Patent: Sep. 29, 2020

(54) SMALL CELL POLE AND MOUNTING SYSTEM AND METHODS OF USE AND INSTALLATION THEREOF

(71) Applicant: nepsa solutions LLC, Chicago, IL (US)

(72) Inventors: David Wigdahl, Elgin, IL (US); Keith Michael Mandoske, Bartlett, IL (US)

(73) Assignee: NEPSA SOLUTIONS LLC, Chicago, IL (US)

( * ) Notice: Subject to any disclaimer, the term of this patent is extended or adjusted under 35 U.S.C. 154(b) by 275 days.

(21) Appl. No.: 15/881,455

(22) Filed: Jan. 26, 2018

(65) Prior Publication Data

US 2018/0219278 A1 Aug. 2, 2018

Related U.S. Application Data

(60) Provisional application No. 62/450,873, filed on Jan. 26, 2017, provisional application No. 62/544,526, filed on Aug. 11, 2017.

(51) Int. Cl.

| | |
|---|---|
| ***H01Q 1/12*** | (2006.01) |
| ***H01Q 1/24*** | (2006.01) |
| ***H01Q 1/46*** | (2006.01) |
| ***H01Q 1/42*** | (2006.01) |
| ***H01Q 1/10*** | (2006.01) |
| ***E04H 12/00*** | (2006.01) |
| ***E04H 12/18*** | (2006.01) |

(52) U.S. Cl.

CPC ..... *H01Q 1/246* (2013.01); *E04H 12/003* (2013.01); *E04H 12/182* (2013.01); *H01Q 1/10* (2013.01); *H01Q 1/1207* (2013.01); *H01Q 1/1235* (2013.01); *H01Q 1/1242* (2013.01); *H01Q 1/42* (2013.01); *H01Q 1/46* (2013.01)

(58) Field of Classification Search

CPC ..... H01Q 1/246; H01Q 1/10; H01Q 1/1207; H01Q 1/1235; H01Q 1/1242; H01Q 1/42; H01Q 1/46; E04H 12/003; E04H 12/182

See application file for complete search history.

(56) References Cited

U.S. PATENT DOCUMENTS

| | | | | |
|---|---|---|---|---|
| 9,698,477 | B1 * | 7/2017 | Jabara | E04H 12/003 |
| 2010/0295751 | A1 * | 11/2010 | Sheers | H01Q 1/10 343/901 |
| 2015/0349399 | A1 * | 12/2015 | Lasier | H01Q 1/1242 343/721 |
| 2017/0279187 | A1 * | 9/2017 | Lockwood | H01Q 1/246 |
| 2018/0044154 | A1 * | 2/2018 | Priest | B66F 11/04 |
| 2018/0351245 | A1 * | 12/2018 | Constance | H01Q 1/44 |

* cited by examiner

*Primary Examiner* — Dameon E Levi
*Assistant Examiner* — David E Lotter
(74) *Attorney, Agent, or Firm* — Vedder Price P.C.

(57) ABSTRACT

The present invention generally relates to a small cell, and more particularly it relates to a small cell pole system, a method for installing a small cell pole system, and to a system and method for mounting components within a capsule in the small cell pole system. The small cell pole system includes an adjustable pole assembly, a capsule with pre-installed communication components, and a base. The mounting system includes a frame including a backplane and a locking bar and one or more removable cards configured to hold a communications component or another associated device.

18 Claims, 37 Drawing Sheets

STEP 1
SELECT PROPER CARD FOR SPECIFIC RADIO OR EQUIP

STEP 2
BOLT RADIO OR EQUIP TO CARD

STEP 3 (FIG. 26a)
TIP CARD UP AND PUT LEG A INTO SLOT IN BACKPLANE

STEP 4 (FIG. 26b)
TIP CARD AND PUSH LEG A UP THROUGH THE SLOT IN BACKPLANE AND ALIGN LEG B TOWARD BOTTOM OF SLOT

SMALL CELL POLE AND MOUNTING SYSTEM AND METHODS OF USE AND INSTALLATION THEREOF

FIELD OF THE INVENTION

The present invention generally relates to a small cell, and more specifically, to a pole system, a mounting system for holding components within a small cell, and methods of installation and use thereof.

CROSS-REFERENCE TO RELATED APPLICATIONS

This application claims the benefit of and priority from U.S. Provisional Patent Application Ser. No. 62/450,873, filed Jan. 26, 2017 and U.S. Provisional Patent Application Ser. No. 62/544,526, filed Aug. 11, 2017, both of which are hereby fully incorporated herein by reference.

BACKGROUND

The explosion of the number of users of smartphones and other mobile computing devices has increased the demands on existing communication networks. As more and more users adopt and use mobile computing devices, such as smartphones, tablets, laptops, netbooks, smart watches and the like, more and more data is transmitted using existing cellular and data networks. This increased usage strains the capacity of existing communication networks and results in the need to expand the capacity and coverage of communication networks.

Populated and urban areas also suffer from localized regions with reduced or poor coverage by existing communication networks. Impediments can include buildings, natural geographic features or other obstacles. Still further, users suffer from nonexistent or poor coverage by existing communication networks due to sparse or nonexistent infrastructure in the form of traditional cellular towers and equipment.

To address these issues, additional infrastructure and equipment can be deployed to areas of capacity-strained, nonexistent or poor coverage of existing communication networks. One approach is to utilize a small cell, a relatively low-powered radio access node that operates in an existing communication network, to provide additional capacity and coverage. The small cells are often lower powered than traditional cellular equipment and are intended to provide localized access coverage to supplement existing communication networks. Existing small cells typically function with only a single network. Thus, when multiple communication networks all require additional capacity, multiple separate small cells are required. Further, existing designs and methods of use, installation and repair for small cells have several drawbacks. In particular, it can be difficult, time-consuming and expensive to access, inspect or replace the equipment (such as radios and/or other electronics) contained within a small cell.

Accordingly, a need exists to address these significant drawbacks in existing small cell designs by providing an improved design and method of installing and holding equipment within a small cell. The system and related methods described in the present disclosure address the drawbacks of existing designs.

BRIEF DESCRIPTION OF THE DRAWINGS

Certain embodiments are shown in the drawings. However, it is understood that the present disclosure is not limited to the arrangements and instrumentality shown in the attached drawings.

DETAILED DESCRIPTION

Figure 1:
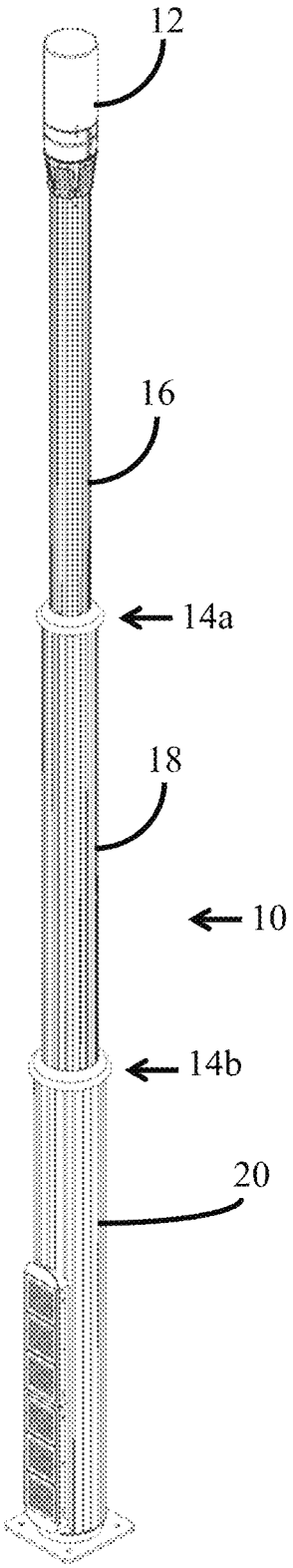
FIG. 1 is an illustration of a pole system in accordance with an embodiment of the present disclosure.

For the purposes of promoting and understanding the principles disclosed herein, reference is now made to the preferred embodiments illustrated in the drawings, and specific language is used to describe the same. It is nevertheless understood that no limitation of the scope of the invention is hereby intended. Such alterations and further modifications in the illustrated devices and such further applications of the principles disclosed and illustrated herein are contemplated as would normally occur to one of skill in the art to which this disclosure relates.

Small Cell Pole System

The small cell pole system as further described below generally provides a structural means for mounting various elements required to provide enhanced capacity and coverage for a communication network in an aesthetically pleasing, economical and reliable package that is easy to install and maintain in a variety of environmental settings. The small cell pole system permits the small cell to be mounted at the desired height at the top of the pole and permits the adjustment of the desired height using the same small cell pole assembly without the need for custom built poles for each different desired height and application. The adjustability of the small cell pole system also eliminates the need for replacement of the pole in the event the height no longer suits the particular location. The various elements of the described small cell pole assembly permit a pre-fabricated assembly to be delivered to an installation location and efficiently installed using minimal equipment and resources.

The small cell pole system of the present disclosure generally includes a pole assembly, a base and a capsule as will be further described. FIG. 1 illustrates one embodiment of pole assembly 10. As shown in this embodiment, pole assembly 10 may include an upper section 16, middle section 18, lower section 20 and antenna assembly 12. Pole assembly 10 includes one or more sections of hollow material that permit the electrical and communication wiring and other desired conduits to be passed through the sections of material. This permits the installed small cell pole system to be aesthetically pleasing as well as reducing exposure to the elements and vandalism or other causes of premature failure. In one embodiment, pole assembly 10 includes three sections of material that may include upper section 16, middle section 18 and lower section 20. Pole assembly 10 may include more or fewer sections of material depending on the desired height of pole assembly 10.

In the example shown in FIG. 1, upper section 16, middle section 18 and lower section 20 are made of pultruded fiberglass. However, other materials and methods of manufacturing can also be used. Other suitable materials may include aluminum, other metal alloys, composites, plastics and the like, so long as the material is capable of withstanding the loading and other structural requirements. In the embodiment shown, upper section 16, middle section 18 and lower section 20 are made of the same material but in other embodiments, the various sections of pole assembly 10 can be made of different materials. In one embodiment, upper section 16 is made of aluminum and middle section 18 and lower section 20 are made of pultruded fiberglass. Still other variations are also contemplated.

Figure 2:
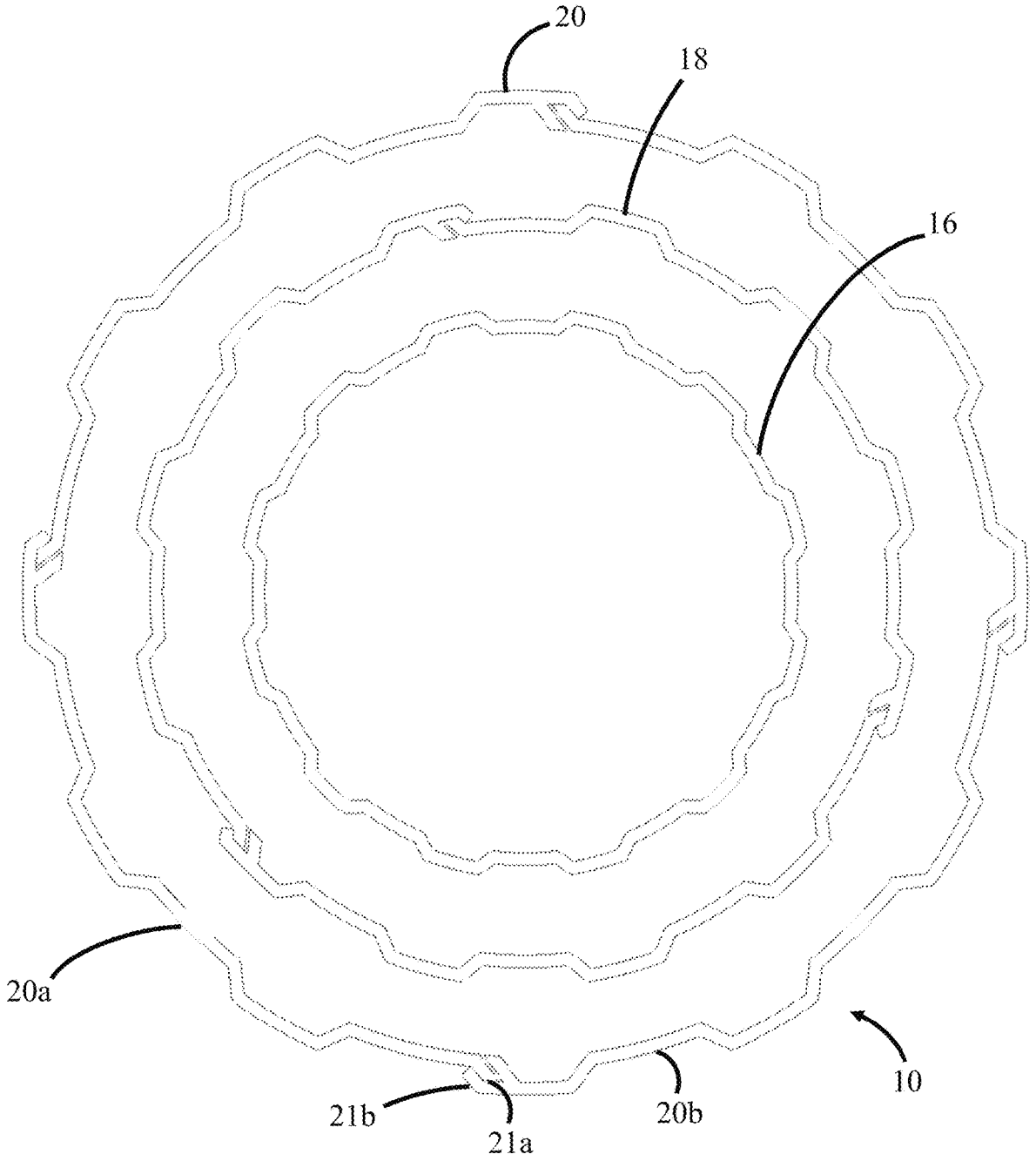
FIG. 2 is an illustration of a horizontal cross-sectional profile of the embodiment of the pole assembly shown in FIG. 1 in a retracted position.

As shown in FIG. 2, in one embodiment of pole assembly 10, upper section 16, middle section 18 and lower section 20 are sized such that each section is capable of nesting inside the section below. In this manner, pole assembly 10 can telescope such that it can be transported more easily to an installation location and be easily manipulated during installation. As can be appreciated, instead of having to transport a thirty-foot long pole to an installation location and then raising the thirty-foot long pole vertically, a nested pole (that could be raised to a height of thirty feet during installation) as contemplated by the present disclosure could be 15 feet or less in the nested configuration for easier transport and initial installation.

In one embodiment of pole assembly 10, the outer diameters of upper section 16, middle section 18 and lower section 20 are ten inches, fourteen inches and eighteen inches respectively. However, other relative sizes of the various sections of pole assembly 10 can also be used.

As also shown in the embodiment of FIG. 2, the profile of various sections of pole assembly 10 can be a fluted profile. In this embodiment, the cross-sectional profile includes twelve flutes around the circumference of each section. As can be appreciated, the size and width of the flutes are configured such that the sections can nest one inside the other as previously explained. In other examples of pole assembly 10, other cross-sectional profiles of the pole sections can also be used. In alternative embodiments, other cross-sectional profiles that may be used include circular profiles, octagonal (or any polygonal) profiles, oval profiles or other fluted profiles, and the like.

In an embodiment, the lower section 20 and the middle section 18 are formed from a plurality of interlocking segments, such as segments 20*a* and 20*b*, which combine to form a portion of lower section 20. Each segment 20*a* and 20*b* includes a first end 21*a* and a second end 21*b* comprising a notch that is sized to hold the first end 21*a* of an adjacent segment. In an embodiment, adjacent segments are held together mechanically (e.g., via friction) without the need for additional fasteners. In alternative embodiments, adjacent segments are joined by suitable fasteners, such as screws, bolts, rivets, pins or the like. Still further, other types of joining processes may be used to secure adjacent sections together such as welding, crimping, staking or the like.

Figure 3:
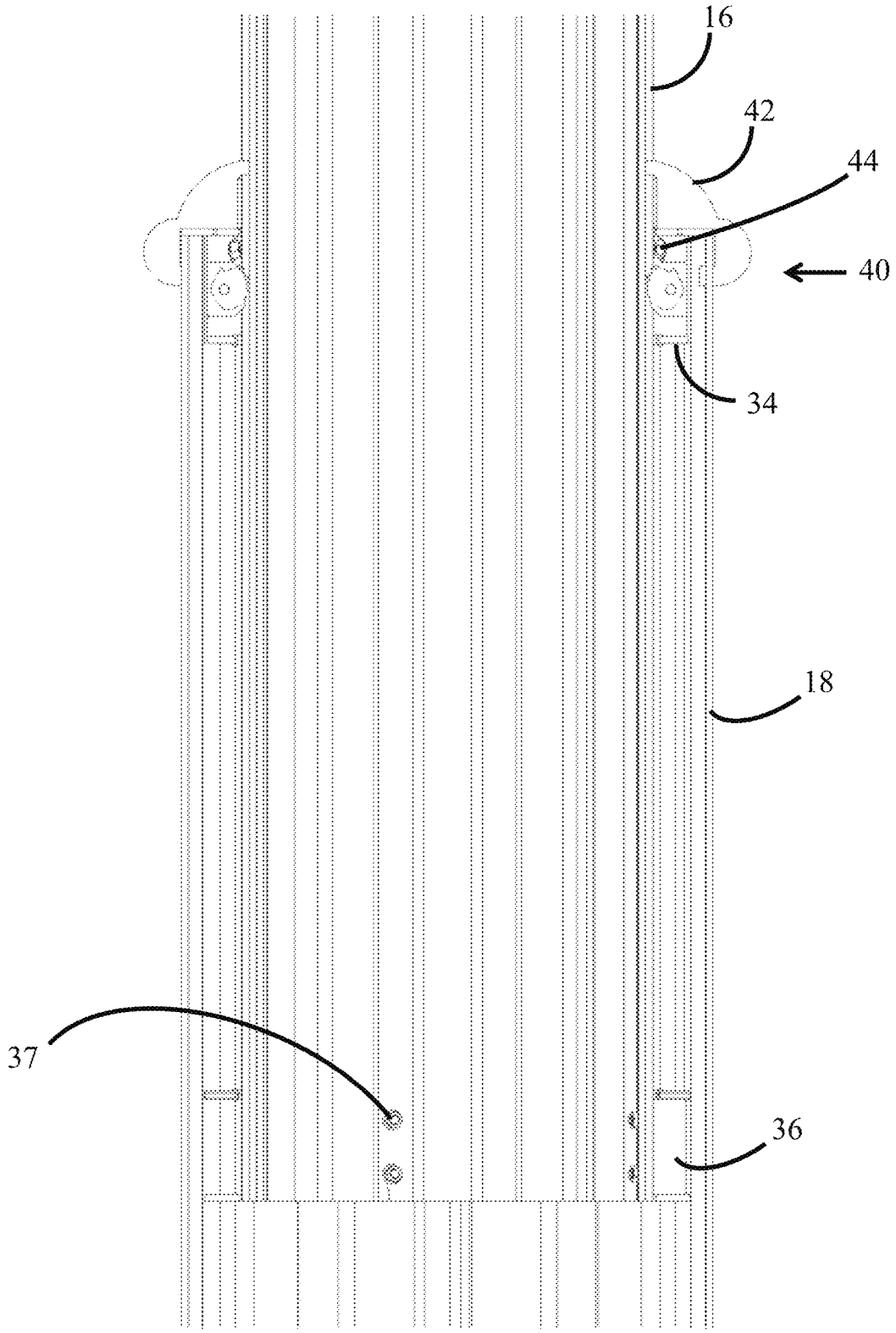
FIG. 3 is an illustration of a vertical cross-sectional profile of a portion of the embodiment of the pole assembly shown in FIG. 1.
Figure 4:
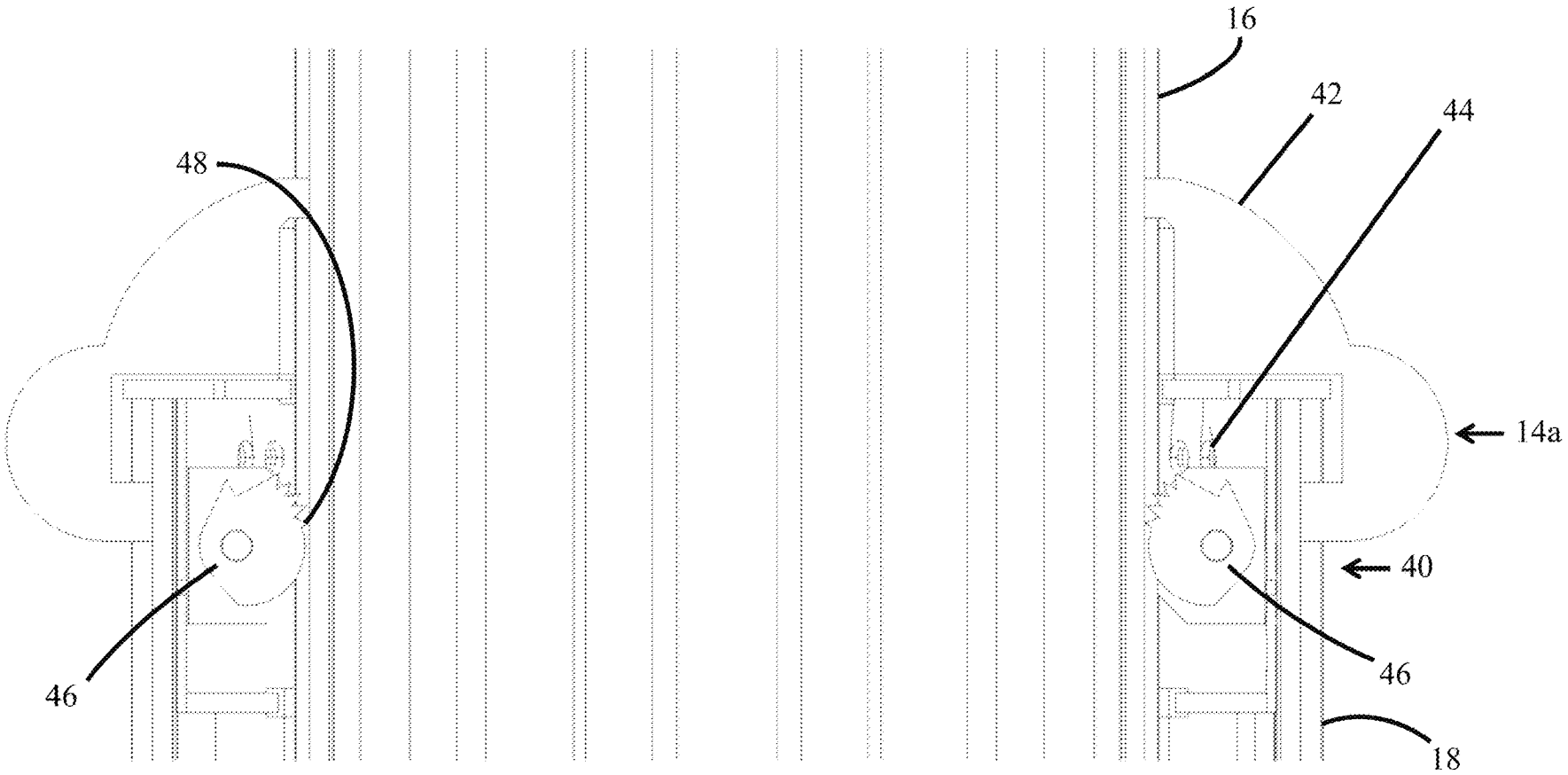
FIG. 4 is an enlargement of the vertical cross-sectional profile of FIG. 3.

As shown in FIG. 1 and in more detail in FIGS. 3 and 4, in an extended or installed position, the various sections of pole assembly 10 have a portion in which a length of each section overlaps with the adjacent section at the interfacing portions as shown, for example, at joint 14*a*. As shown in this example, a length of upper section 16 extends inside middle section 18 at joint 14*a*. The same relative structure exists, in this example, at the interfacing location of middle section 18 and lower section 20 in which a length of middle portion 18 extends inside lower section 20 at joint 14*b*. In one example, the lower three feet of upper section 16 extends inside middle section 18 and the same relative length of middle section 18 extends inside lower section 20. Different lengths may extend inside the interfacing section depending on the structural requirements of pole assembly 10, the materials comprising the various sections of the pole assembly 10 and the cross-sectional configurations of the pole assembly 10, as can be appreciated by one of ordinary skill in the art.

As shown in FIGS. 1, 3 and 4, an embodiment comprising an advantageous structure for joining the sections of pole assembly 10 is shown. In this embodiment, at the interfacing region of the sections, a cam-lock assembly 40 is provided to secure the sections of pole assembly 10. Cam-lock assembly 40 includes one or more cams 46. In this embodiment (as shown at the interface of upper section 16 and middle section 18), one or more cams are connected to the inner surface of middle section 18. The one or more cams are connected in a spaced relationship to one another in this embodiment around the inner circumference of middle section 18. The spaced relationship of the one or more cams 46 can vary depending on the cross-sectional profile of middle section 18. In one example, on a middle section 18 that has the cross-sectional profile shown in FIG. 2, nine cams are spaced around the inner circumference of middle section 18. In other examples, a greater or fewer number of cams can be used. Still further, more than one row of cams 46 is also contemplated. In one example, a single row of cams 46 is used. In an alternative embodiment, two or more rows of cams 46 are used in which a plurality of rows of cams are spaced axially apart from one another.

In an alternative embodiment, one or more rows of fasteners are installed through the outer section and into and/or through the inner section to join the two sections together in place of the cams. Any type of suitable fastener can be used, such as screws, bolts, rivets, pins or the like. Still further, other types of joining processes could be used to secure the sections together such as welding, crimping, staking or the like.

Referring back to the embodiment shown in FIGS. 3 and 4, the one or more cams 46 may have teeth or other features that increase the frictional force exerted at gripping surface 48 at the portion that interfaces with upper section 16 at gripping surface 48. Cam-lock assembly 40 provides an advantageous structure for securing the interfacing sections of pole assembly 10 relative to one another.

As can be appreciated, in a nested configuration of pole assembly 10 as previously described, one section is inside of the interfacing section. For purposes of illustration, the interface of upper section 16 and middle section 18 as shown in FIGS. 3 and 4 will be described. However, such a structure and method of use also may exist at the interface of middle section 18 and lower section 20 or any other interfacing sections of pole assembly 10, if pole assembly 10 includes more sections than as shown in the illustrated embodiments.

In the nested configuration, upper section 16 resides inside middle section 18. During installation of pole assembly 10, a force is exerted at the top of upper section 16 pulling upper section 16 relative to middle section 18 such that upper section 16 moves in an axial direction and slides out of the nested configuration and into an extended configuration as shown in FIG. 1. As upper section 16 slides in an axial direction upward from middle section 18, upper section 16 is permitted to slide past cams 46 as cams 46 are rotated away from the upper section 16. When upper section 16 is pulled and is at the desired height of installed pole assembly 10, the weight of upper section 16 (and any elements that may be mounted thereto) causes upper section 16 to move downward, causing the cams 46 to rotate and engage with the gripping surface 48. The frictional force between cams 46 and gripping surface 48 (that may be increased by teeth or other features on cams 46) cause cams 46 to rotate about the pin at the attachment of cams 46 to the inner surface of middle section 18. Due to the shape of cams 46, this action causes the distal end of cams 46, that is the end away from the point of rotation of cam 46, to move toward gripping surface 48. This rotation increases the frictional force between cams 46 and gripping surface 48 and secures upper section 16 relative to middle section 18. As can be appreciated, upper section 16 can be released from its secured position by pulling up in an axial direction to cause the reverse of the foregoing described action to release cams 46 from their secured rotated position to permit upper section to be moved relative to middle section 18.

FIGS. 3 and 4 illustrate one example of cam-lock assembly 40. Other configurations can also be used that include other shapes and sizes of cams 46 as well as other arrangements of cams 46. For example, cams 46 may be positioned at differing positions relative to the terminating end of middle section 18.

As further shown in FIGS. 3 and 4, additional fasteners or other securing members 44 can be used to complement or provide additional security against movement of the sections of pole assembly 10 relative to each other. Also as shown, a seal 42 can be provided at the joints 14*a* and 14*b* of the sections of pole assembly 10. Given the differing sizes of the interfacing sections of pole assembly 10, rain, snow or other environmental elements would be permitted to enter pole assembly 10 unless a feature is provided to close and/or seal the gap between the interfacing sections. In this example, an elastomeric seal 42 is provided that fits over the pole and closes the gap between the sections. Any suitable elastomeric material can be used such as rubber, plastic or composite or the like. In other examples, a foam, caulk or other sealing material can be added to provide similar sealing functionality.

Referring now to FIG. 3, in one embodiment, a feature is provided at the bottom of a section of pole assembly 10 to prevent one section from being pulled out of an interfacing section during assembly. Without such a feature, for example, upper section 16 could be pulled out of middle section 18 when pole assembly 10 is extended during installation. Such could also be the case at the interface portion between middle section 18 and lower section 20. In the embodiment shown in FIG. 3, a ring or extending feature 36 is fixed to the exterior surface of upper section 16 proximate the bottom edge of upper section 16. The ring 36 extends outward such that it extends radially outward from an outer circumferential surface of upper section 16. The ring 36 effectively increases the outer diameter of upper section 16. A complementary feature, bumper 34, is provided on the inner surface of middle section 18. Bumper 34 extends radially inward from the inner circumferential surface of middle section 18. In this configuration, as upper section 16 moves axially upward from a nested configuration to an extended position, the ring 36 contacts bumper 34 to prevent upper section 16 from being completely withdrawn from middle section 18. In an embodiment, ring 36 is affixed to upper section 16 using one or more fasteners 37, such as bolts or other suitable fasteners (as described herein). As can be appreciated, middle section 18 and lower section 20 can be fitted with similar features to provide similar results.

The ring 36 and bumper 34 configuration depicted in FIG. 3 is only one example of a restriction feature. In an alternative embodiment, a cap is fit onto the bottom of middle section 18. The cap has an upstanding flange and a bottom plate. The upstanding flange extends into and connects at the bottom edge of middle section 18. The bottom plate of cap 36 is connected to the upstanding flange and extends outward such that it extends radially outward from an outer circumferential surface of middle section 18. Much like the ring 36, as middle section 18 moves axially upward from a nested configuration to an extended position, the cap contacts bumper 34 to prevent middle section 18 from being completely withdrawn from lower section 20. In further alternative embodiments, a bumper in the form of an L-bracket, crimped indention feature, a fastener extending inwardly or the like, which is positioned on lower section 20, is used to provide similar retention to that previously described, in that it prevents middle section 18 from being removed from lower section 20 during installation. Still other retention features are also contemplated.

Figure 5:
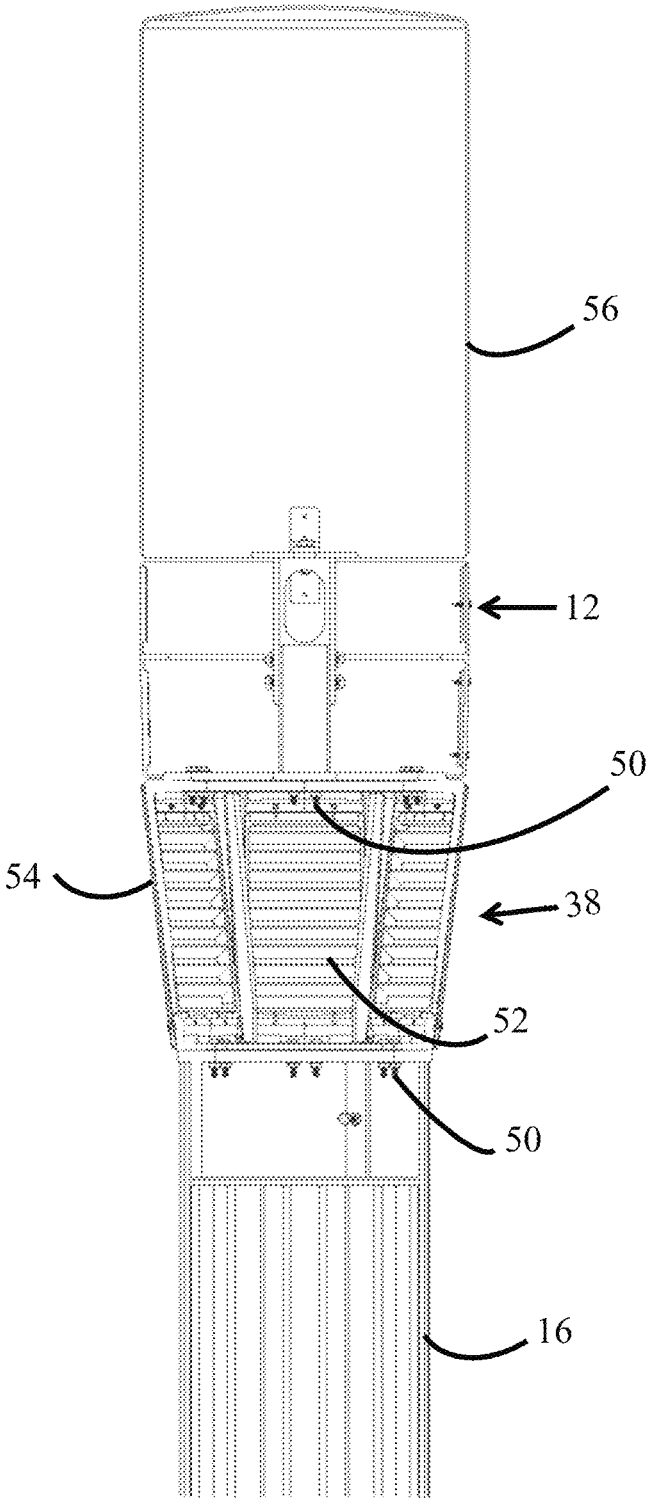
FIG. 5 is an illustration of the antenna portion of the embodiment of FIG. 1.
Figure 6:
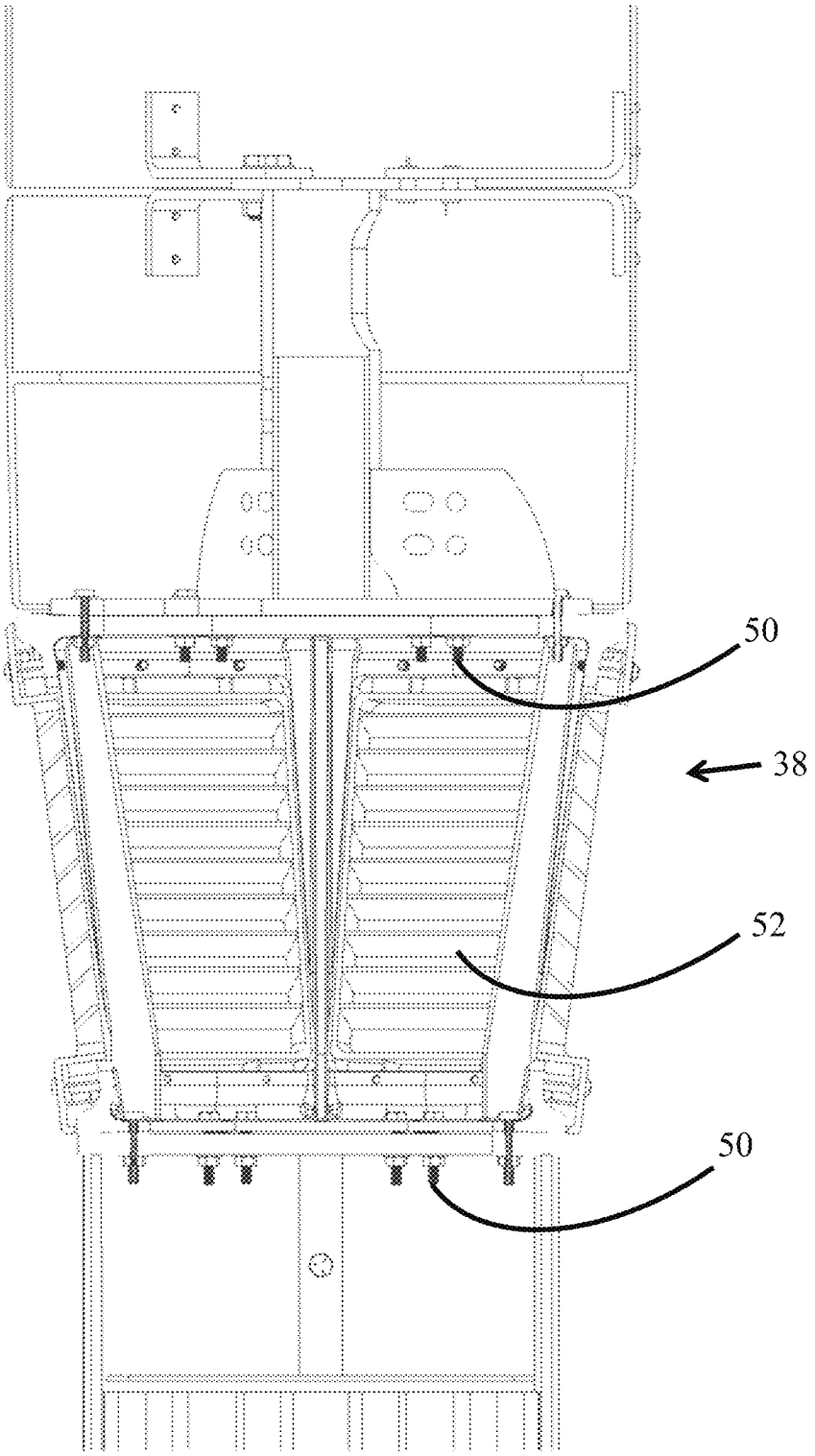
FIG. 6 is an enlargement of the illustration of FIG. 5.

Referring now to FIG. 5, antenna assembly 12 and transition portion 38 are shown. Antenna 56 can be any antenna suited for a communication network to which the small cell pole system is intended. In one example, antenna 56 is cylindrical as shown. Antenna assembly also includes support 54 that connects antenna 56 to upper section 16. In this example, support 54 is frusto-conical in shape and includes one or more vent covers 52 that are removable such that the electrical connections of antenna 56 to the related communications equipment can be accessed and serviced as necessary. Any suitable material can be used for support 54 and vent cover 52 including plastics, composites, aluminum, other metal alloys and like. Antenna assembly 38 also includes a portion that may extend into upper section 18 and then connected thereto. In other examples, antenna assembly 38 extends over and around upper section 18 and is similarly connected. While fasteners 50 are depicted in the embodiment shown in FIG. 5, other methods of attachment may also be used such as welding, adhesive, crimping, staking or the like.

Figure 7:
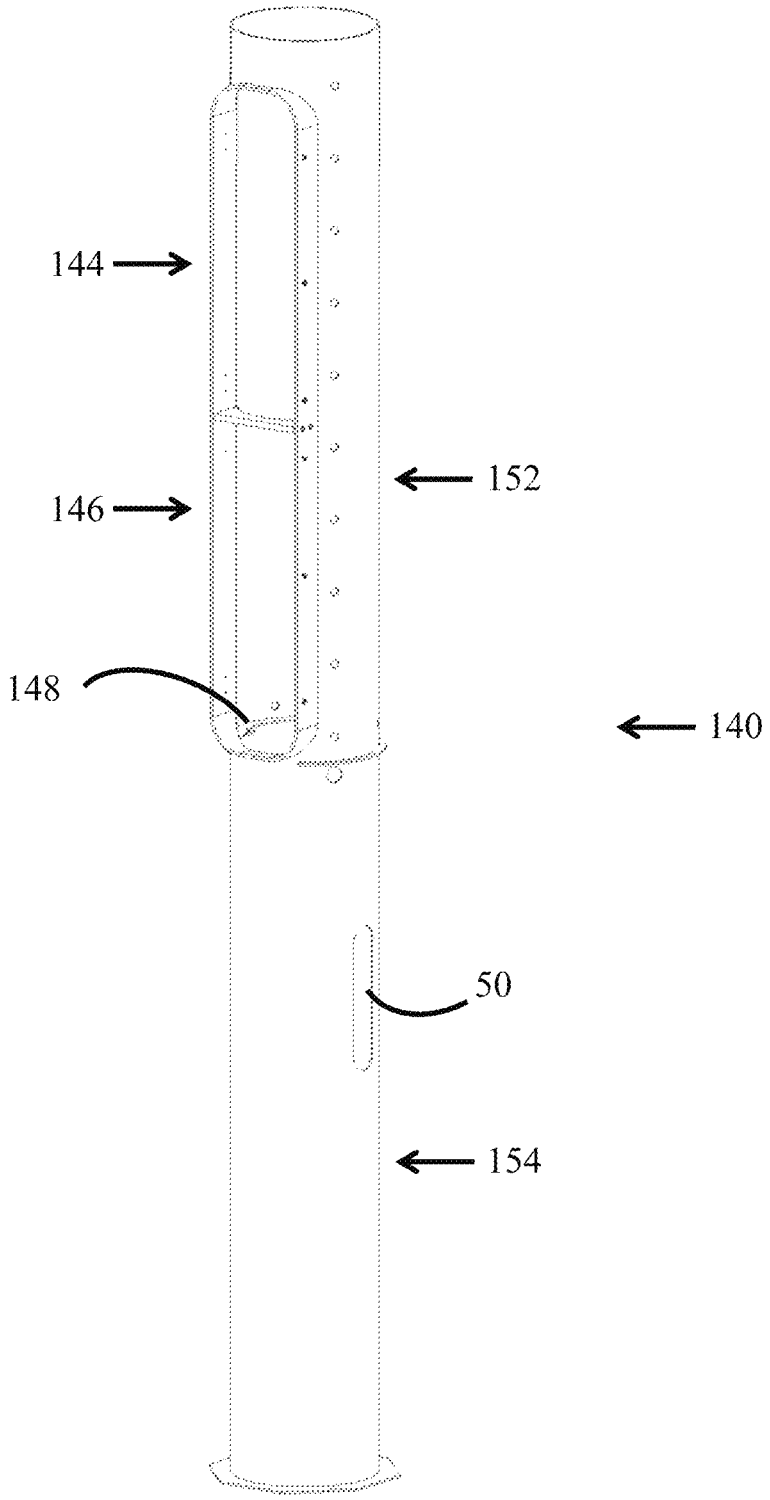
FIG. 7 is an illustration of an embodiment of a base of present disclosure.
Figure 8:
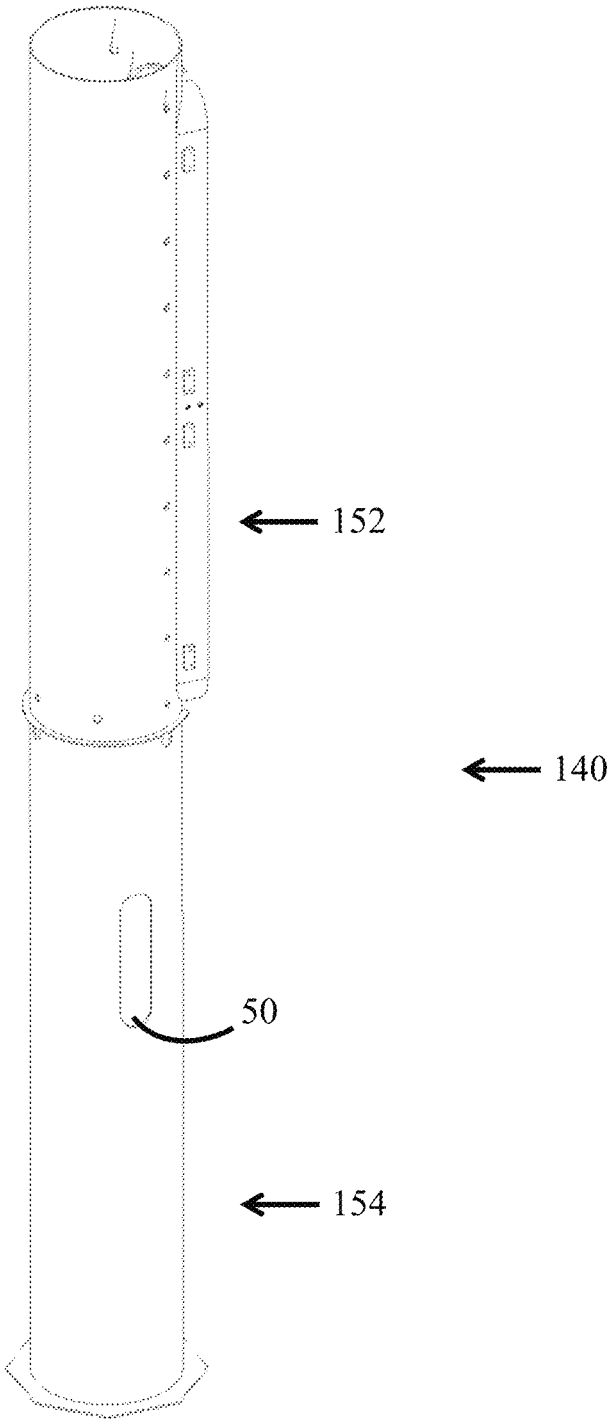
FIG. 8 is another view of the embodiment of the base depicted in FIG. 7.
Figure 9:
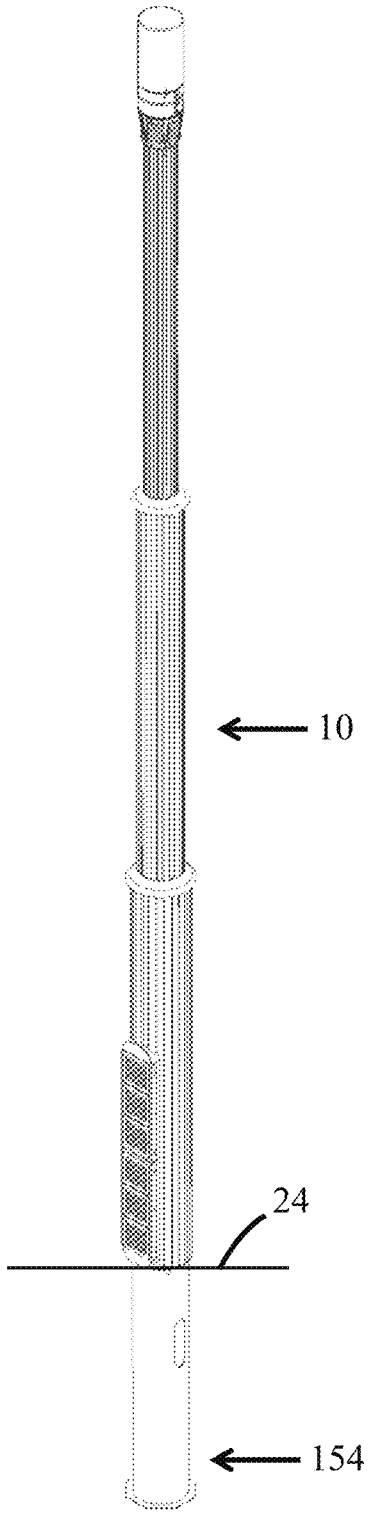
FIG. 9 is an illustration of a pole system in accordance with an embodiment of the present disclosure, including the base of FIG. 7.
Figure 10:
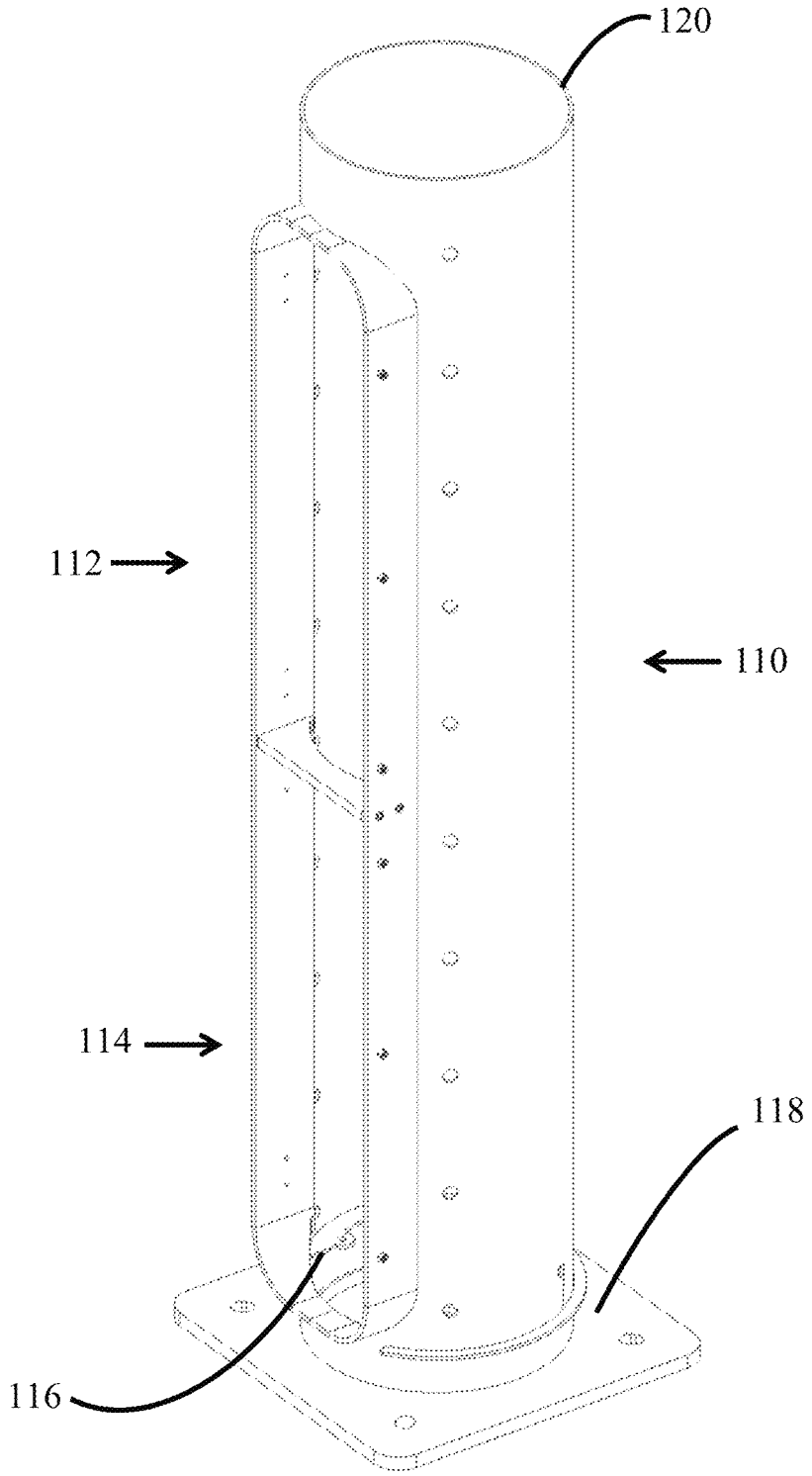
FIG. 10 is an illustration of another embodiment of a base of present disclosure.
Figure 11:
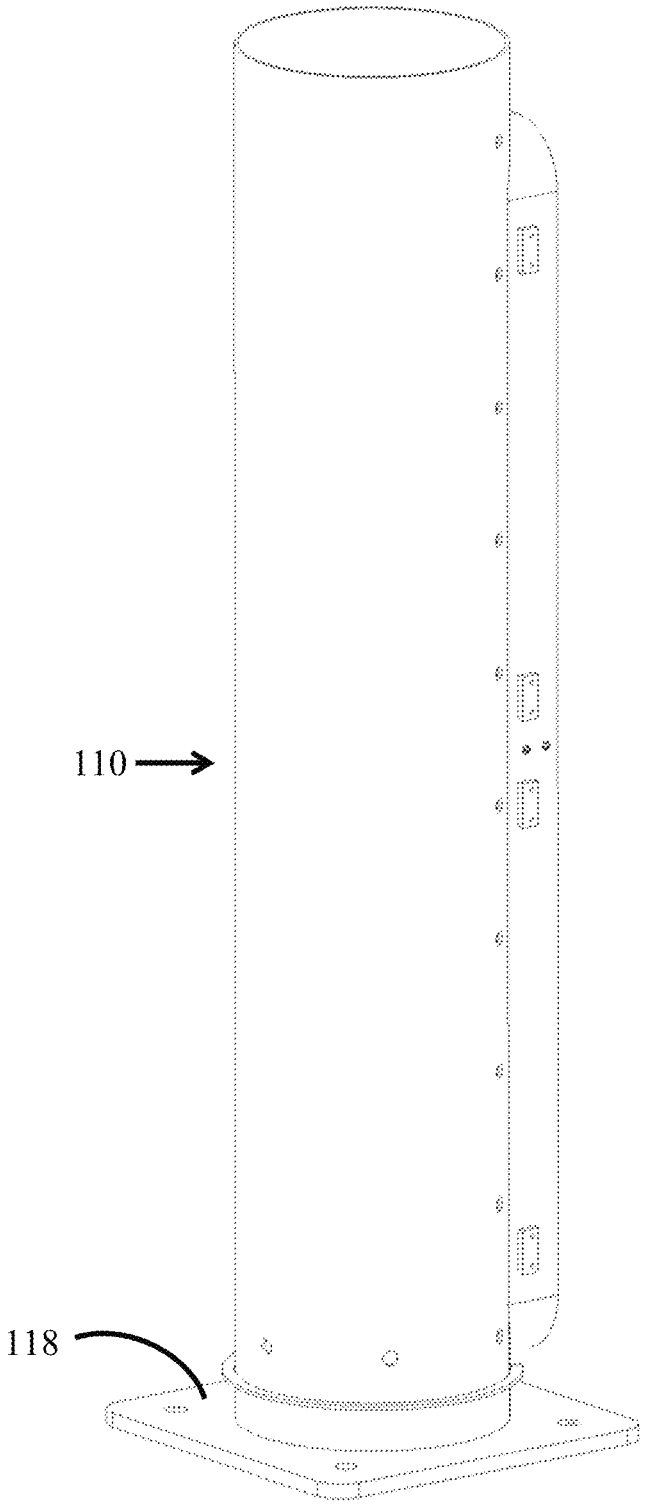
FIG. 11 is another view of the embodiment of the base depicted in FIG. 10.

Small cell pole assembly 10, in one embodiment, is fixed at an installation location using a base. The base may be a surface-mounted base 110 as depicted in FIGS. 10, 11, 12, and 13 or an embedded base 140 as depicted in FIGS. 7, 8 and 9. Embedded base 140 is intended to be fixed at an installation location by embedding a lower portion 154 of embedded base 140 into the ground using concrete or another suitable material.

As illustrated in FIG. 9, lower portion 154 of embedded base 140 is placed below grade 24 and upper portion 152 extends above grade 24. In one example, lower portion 154 and upper portion 152 are six feet in length. In other examples, other lengths can be used. Embedded base can be made of galvanized steel or other suitable material. As shown on FIG. 7, upper portion of embedded base 140 may include an upper access 144 and a lower access 146. Upper access 144 and lower access 146 are openings in embedded base 140 that permit access to the electronic communications equipment that is installed into the base via the capsule as will be explained. Embedded base 140 may also include surface ring 142 that is located at grade after installation of embedded base 140. Lower portion 154 may also include below-grade access point 150 that may be an elongated hole as shown. Below-grade access point 150 permits access to the interior of embedded base 140 so that electrical power and communications network lines can be passed from underground conduits into embedded base 140.

As further shown in this embodiment, embedded base may include seat 148. Seat 148 provides a location on which capsule 80 will sit after it is installed into the base. In this embodiment, seat 148 is a partial ring of material fixed at a predetermined location on the inside surface of the upper portion of embedded base 140. Seat 148 extends radially inwardly and causes capsule 80 to be positioned at a desired location inside the base so that the electronic and communication equipment installed on capsule 80 can be accessed through upper access 144 and lower access 146. Other configurations of seat 148 can also be used including L-brackets, crimped indentions, extending fasteners or other radially inward extending features.

FIGS. 10, 11, 12 and 13 illustrate another embodiment of the base. In this embodiment, a surface-mounted base 110 is shown. Surface-mounted base 110 may include similar features described above such as an upper access 112, lower access 114 and seat 116. In this embodiment, surface mount 118 is also provided. Surface mount 118 in this example is a flanged feature with attachment locations that permit surface-mounted base 110 to be installed on surface bolts. Surface mount 118 can be of various shapes and sizes to provide a mounting surface to coordinate with the attachments that may be contemplated at an installation location.

Figure 12:
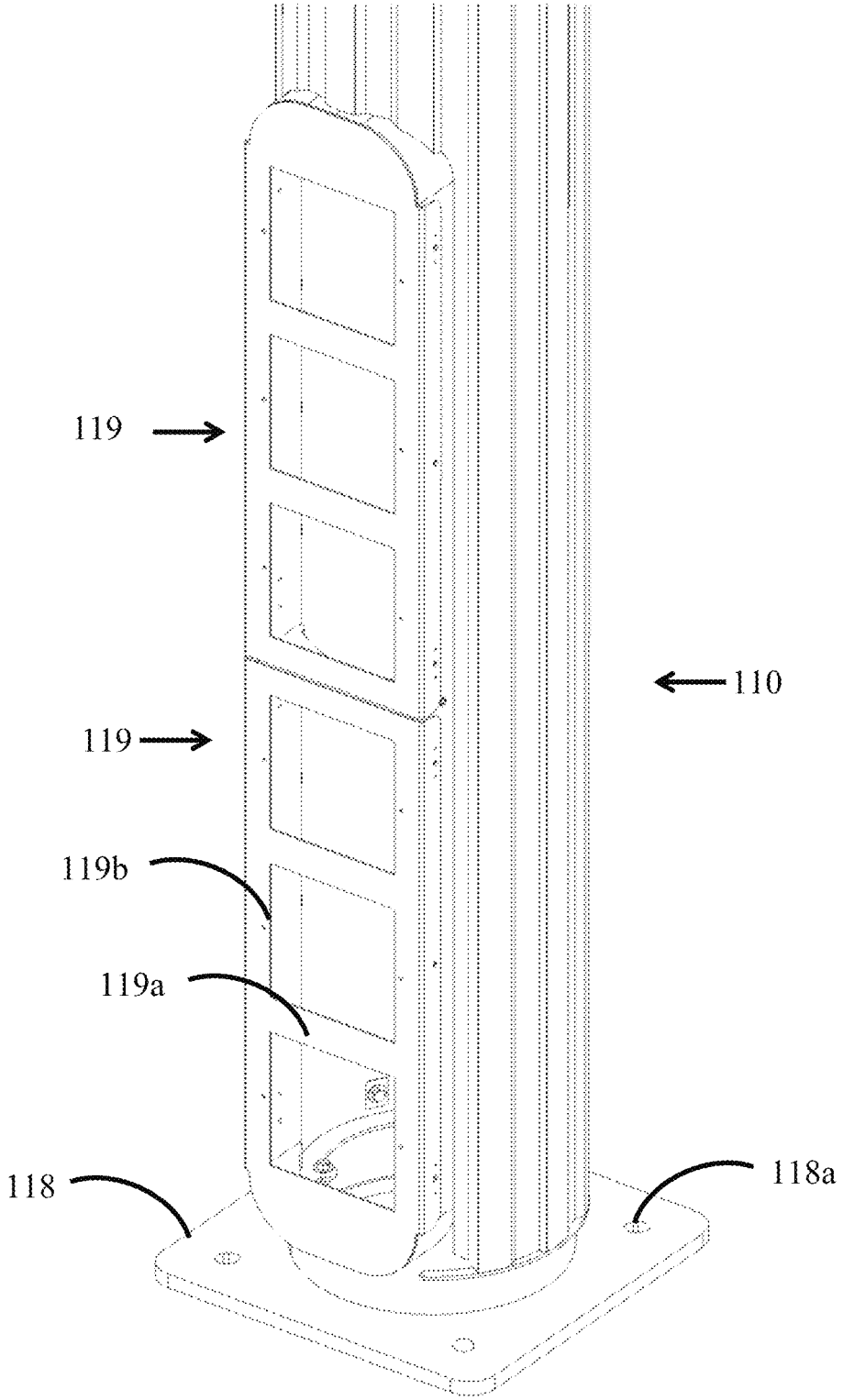
FIG. 12 is another view of the embodiment of the base depicted in FIG. 10 with the pole and door covers installed.
Figure 13:
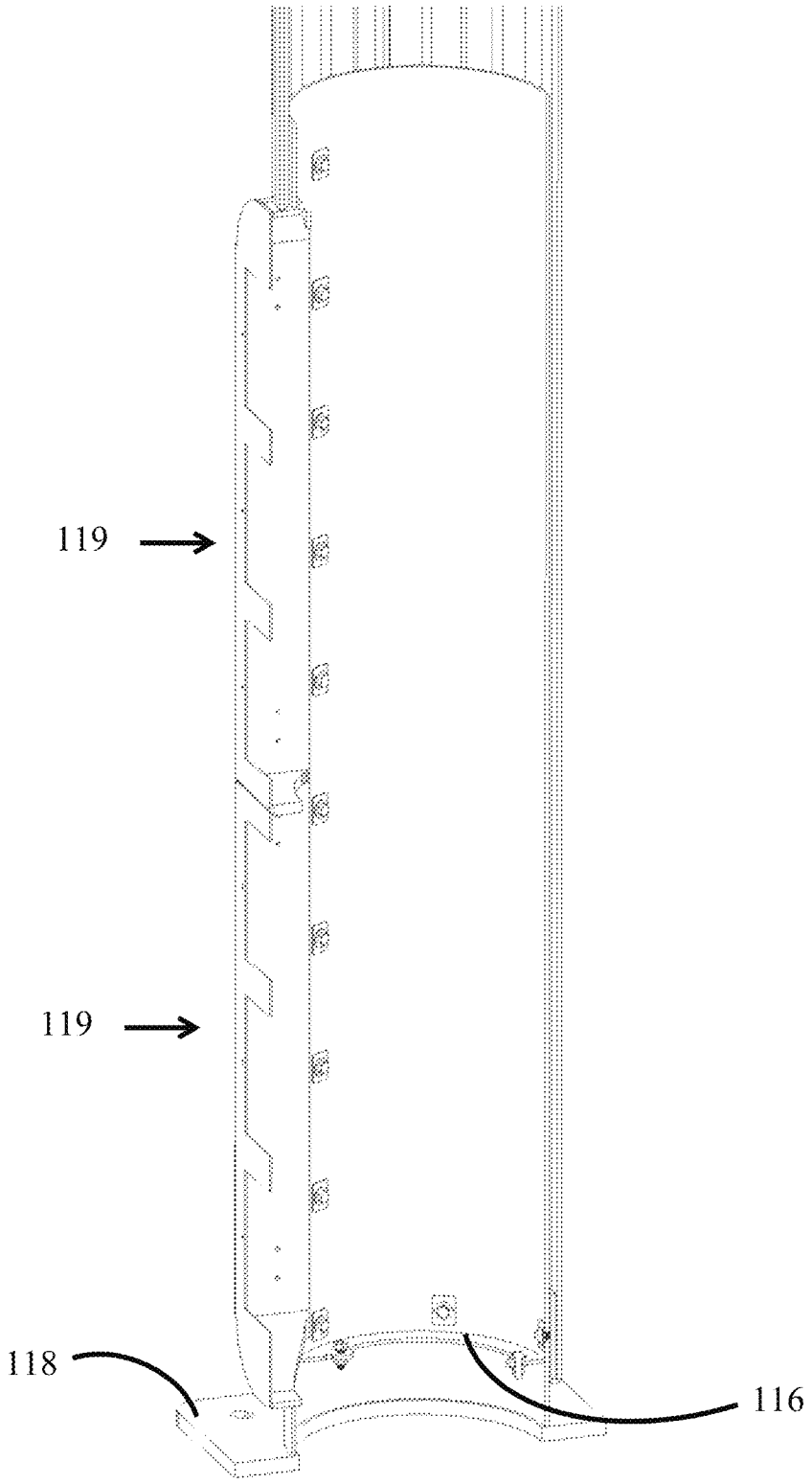
FIG. 13 is a cross-sectional view of the embodiment of the base depicted in FIG. 12.

As shown in FIGS. 12 and 13, in an embodiment, the base (either surface mounted base 110 or embedded base 140) may include one or more covers 119. As shown, covers 119 are installed over upper access 112 and lower access 114 and each includes a plurality of horizontal bars **119*a* spaced apart by openings 119*b*. In alternative embodiments, different structures of covers may be used, including solid plates, mesh coverings, and coverings with differing arrangements of bars 119*a* and openings 119*b*. The coverings 119 are removably installed using fasteners such as bolts to permit access to the interior of the small pole system. In an alternative embodiment, the covers are installed using hinges on a first side and fasteners on an opposite side, so as to permit the covers 119** to swing open when the fasteners are removed. This provides more convenient access to the interior of the small cell pole system while simultaneously ensuring that the covering is secured. In an embodiment, a lock or other secure fastener to prevent ready access by unauthorized individuals is used.

As discussed in greater detail below, a capsule contains all of the electrical and communication components for the small cell pole system. In an embodiment, the capsule has a generally cylindrical shape and is advantageously configured so as to fit within the base (in either the surface-mounted or embedded configuration). The capsule has an outer diameter that is smaller than the inner diameter of the base. The outer diameter of the bottom of the capsule is larger, however, than the inner diameter of the base at seat 148 so that when the capsule is inserted into the base, it is restricted from moving downward into the base when it comes into contact with seat 148. The capsule can also be fit with set screws or other fasteners to secure the capsule into location when it is sitting on seat 148 in the base. Foam, spacers or other materials can also be used to prevent capsule 80 from vibrating or moving radially inside of the base after it is inserted inside of the base.

The foregoing elements of the small cell pole system provide a robust, efficient and economical solution for adding capacity and coverage to a communication system. The installation of the small cell pole system provides many advantages.

Method of Installing Small Cell Pole

The installation process of the small cell pole system described herein is particularly advantageous. Such method of installation will now be explained.

Upon determining a location at which a user wants to install the small cell pole system, the various elements are delivered to the installation location. The pole assembly, the base and the capsule arrive at the installation location. As previously described, the pole assembly is delivered in a nested configuration in which the various sections of pole assembly 10 are nested one inside another such that the length of the nested pole assembly is significantly shorter than traditional poles that arrive at their installed length. Depending on the nature of the installation location, a surface-mounted base 110 or an embedded base 140 is included with the installation package. The base is appropriately installed onto the surface location or is embedded at the installation location.

Next, the capsule 80 is inserted into the base. The capsule 80 arrives at the installation site with the appropriate electrical and communication components pre-installed according to a user's specifications. This significantly reduces the labor and installation time that are performed at the installation location. The capsule is inserted until it contacts the seat 148 of the base and the capsule is then secured into its location. The electrical power and communications fiber can be connected to the electrical and communication components via pre-installed connection points in the capsule.

The pole assembly 10 in a nested configuration can then be installed over the base. The lower section 20, for example, is installed over the base and the bottom portion of lower section 20 is secured to the base at connection points near the bottom of lower section 20. Care is taken at this stage to align upper portal 30 and lower portal 28 of pole assembly 10 with the upper access 112 and lower access 114 of the base so that the electrical and communication components located on capsule 80 are accessible. Connections between the communications components located on the pole and capsule can be made. Pole assembly 10 arrives at the installation location pre-wired and configured according to a user's specifications.

After the pole assembly 10 is positioned on the base, a boom or other equipment can be used to raise the pole from the nested configuration to the extended configuration. In one embodiment of pole assembly 10, the upper section 16 of pole assembly 10 is lifted in an axial direction. This action causes the various sections of pole assembly 10 to move relative to one another in an axial direction. As the various sections ground out because of the restriction features previously described (i.e., the cap 36 and bumper 34, in one example), the pole assembly 10 can be raised to a desired height. Once the desired height is reached, the various sections can be fixed relative to one another. In one example, the cam-lock assembly automatically secures the various sections relative to one another once the pole assembly is raised to the desired height.

As can be appreciated, the height of a small cell pole system is critical in providing the desired coverage of the communication network. One advantage of the small cell pole system of the present disclosure is that the height of the installed pole assembly can be adjusted. Given the cam-lock assembly as previously described, the upper section 16 of pole assembly 10 can be lifted and the cams 46 of cam-lock assembly 40 can be released to adjust the height of the pole assembly. Upon reaching a desired height, the cam-lock assembly can re-secure the relative height of the interfacing sections of pole assembly 10 at a new height.

The variable height capability of the small cell pole system described also permits a single pole assembly 10 to serve various desired heights at various installation locations using the same pole assembly 10. Instead of needing to order many different height poles for different installation locations, an installer can order the same pole assembly 10 and then install the same pole assembly 10 at various heights given the adjustability and versatility previously described.

Small Cell Pole Capsule and Mounting System

Embodiments of the small cell mounting system as further described below generally provide a structural means for easily mounting various elements required to provide enhanced capacity and coverage for a communication network in a capsule within a small cell pole system in a manner that is easy to install and maintain in a variety of environmental settings. The small cell mounting system permits the electrical and communication components of the small cell to be secured in a modular fashion without the need for specialized hardware to mount different components. The adjustability and modular nature of the system enables multiple communication networks to be used with a single small cell and allows for the easy maintenance, inspection, replacement or upgrade of installed components. The system also allows for technicians to efficiently access, inspect, install and replace components using minimal equipment and resources.

As discussed above, the capsule is the element of the small cell pole system in which the electrical and communication components are installed.

Figure 14:
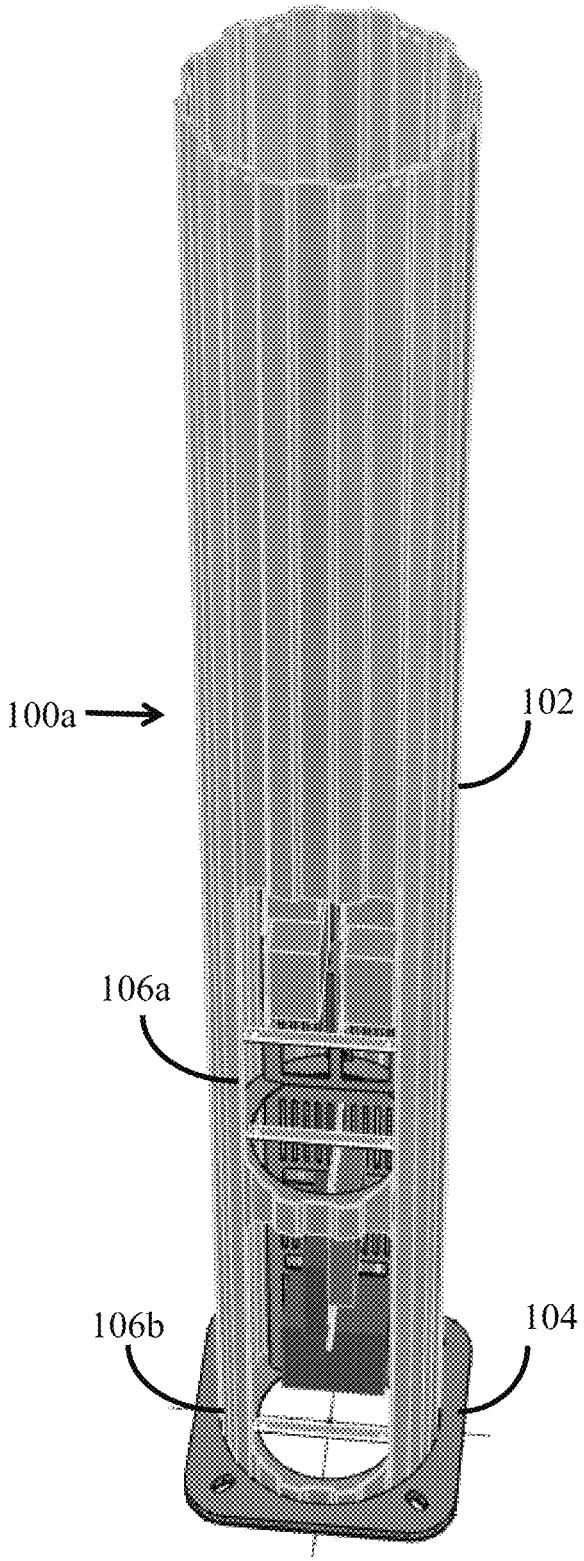
FIG. 14 is a perspective view of a base of a small cell pole structure in accordance with one embodiment of the present disclosure.
Figure 15:
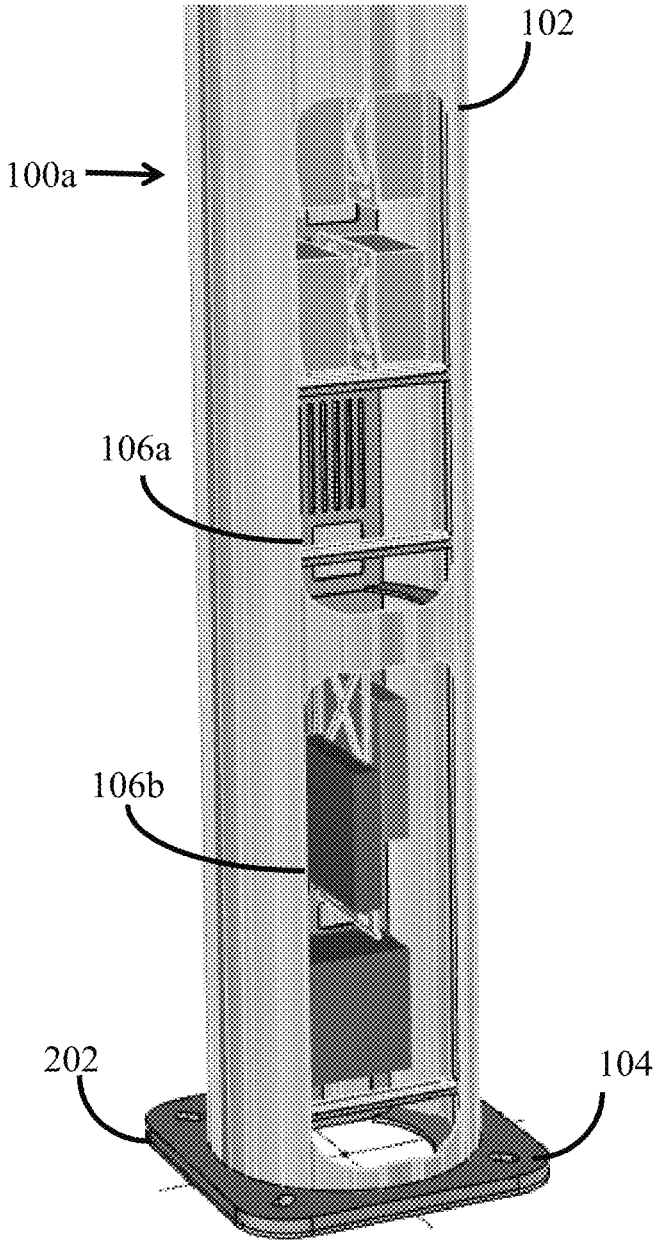
FIG. 15 is a close-up perspective view of the embodiment of a base of a small cell pole structure of FIG. 14.

As shown in FIGS. 14 and 15, a small cell base 100*a* (which may be, by way of example, either surface-mounted base 110 or embedded base 140) in accordance with an embodiment of the present invention includes a small cell pole structure 102 (which may be installed within lower section 20) that is connected to a flange 104 and a base plate 202. The base plate 202 may be affixed to the ground or another surface to secure the small cell base 100*a* in place, while the flange 104 is affixed to the base plate and the pole structure 102. In the embodiment shown, the flange 104 is square in profile and includes four openings, one at each corner, to secure the flange 104 to the ground. The openings may be sized to accept suitable fasteners such as anchor bolts, bolts and the like. The pole structure 102 is generally in the form of a hollow cylinder with an open space within the interior of the exterior casing 102 that contains the various electrical and communication components used in the small cell base 100*a*. The communication components may be operatively connected to an antenna assembly (such as antenna assembly 12) mounted to the pole structure via wiring contained within the pole structure. Other configurations of the pole structure 102 can also be used as well as pipes, boxes or other shapes to provide the functionality as described herein.

In an embodiment, the pole structure 102 incorporates one or more openings 106*a* and 106*b* that provide access to the interior. The one or more openings 106*a* and 106*b* are sealed with a covering to protect the components of the small cell 100 from the environment and prevent unauthorized access. As will be readily understood, the one or more openings 106*a* and 106*b* may be sized and shaped as necessary to provide access to the components of the small cell base 100*a*. In an embodiment, the openings are square, ovoid, rounded rectangles or the like.

In an embodiment, the pole structure 102 is made of aluminum, steel or pultruded fiberglass. However, other materials and methods of manufacturing can also be used. Other suitable materials may include aluminum, other metal alloys, composites, plastics and the like, so long as the material is capable of withstanding the loading and other structural requirements. Still other variations are also contemplated. In the embodiment shown, the outer surface of the pole structure 102 includes a plurality of fluted indentations around the circumference of the pole structure 102. In other embodiments, other cross-sectional profiles can also be used. Other cross-sectional profiles that can be used include circular profiles, octagonal (or any polygonal) profiles, oval profiles, other fluted profiles and the like.

Figure 16:
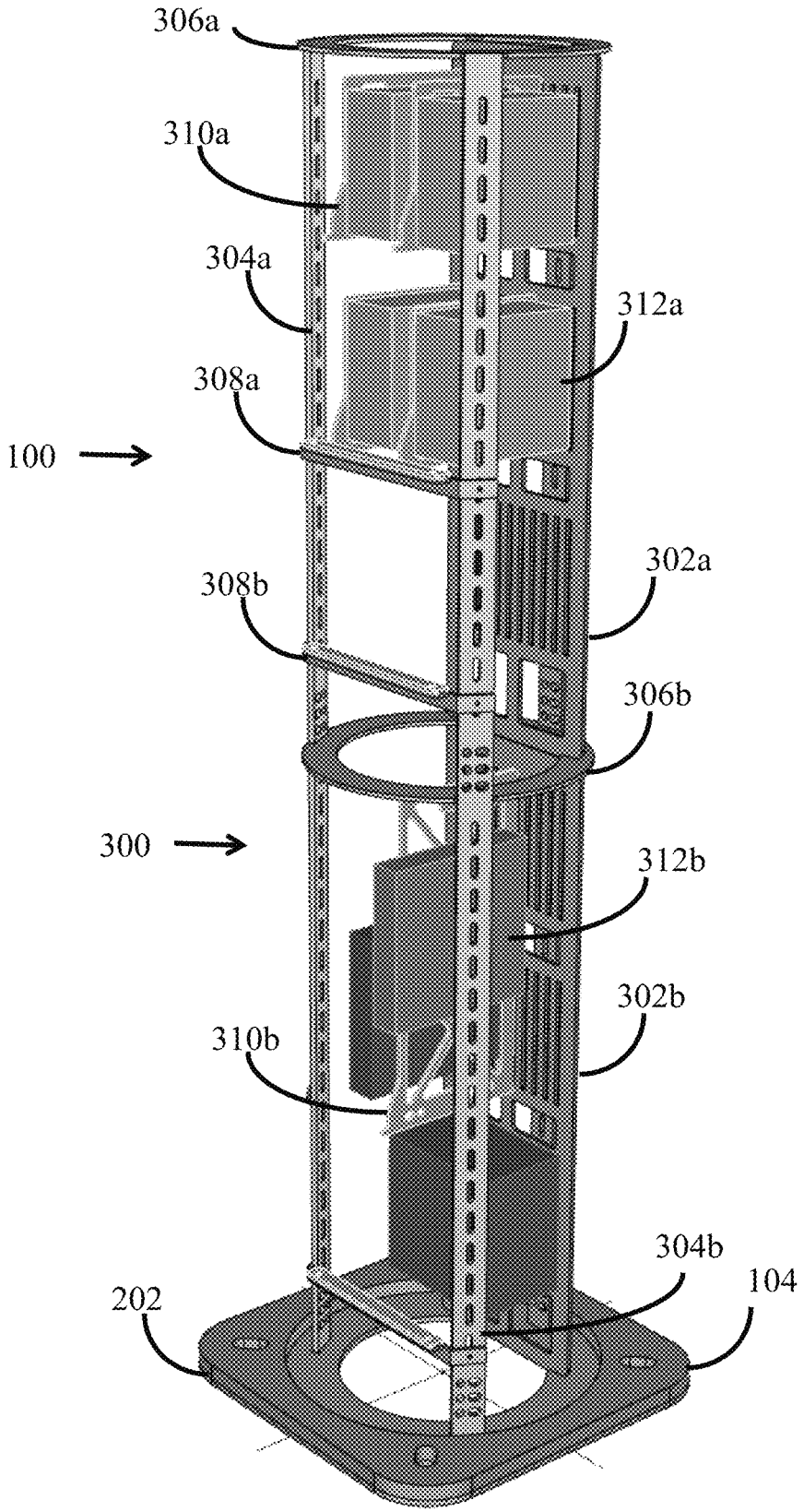
FIG. 16 is a perspective view of the interior of the small cell capsule located within the small cell pole structure of FIG. 14 with the pole structure removed.
Figure 17:
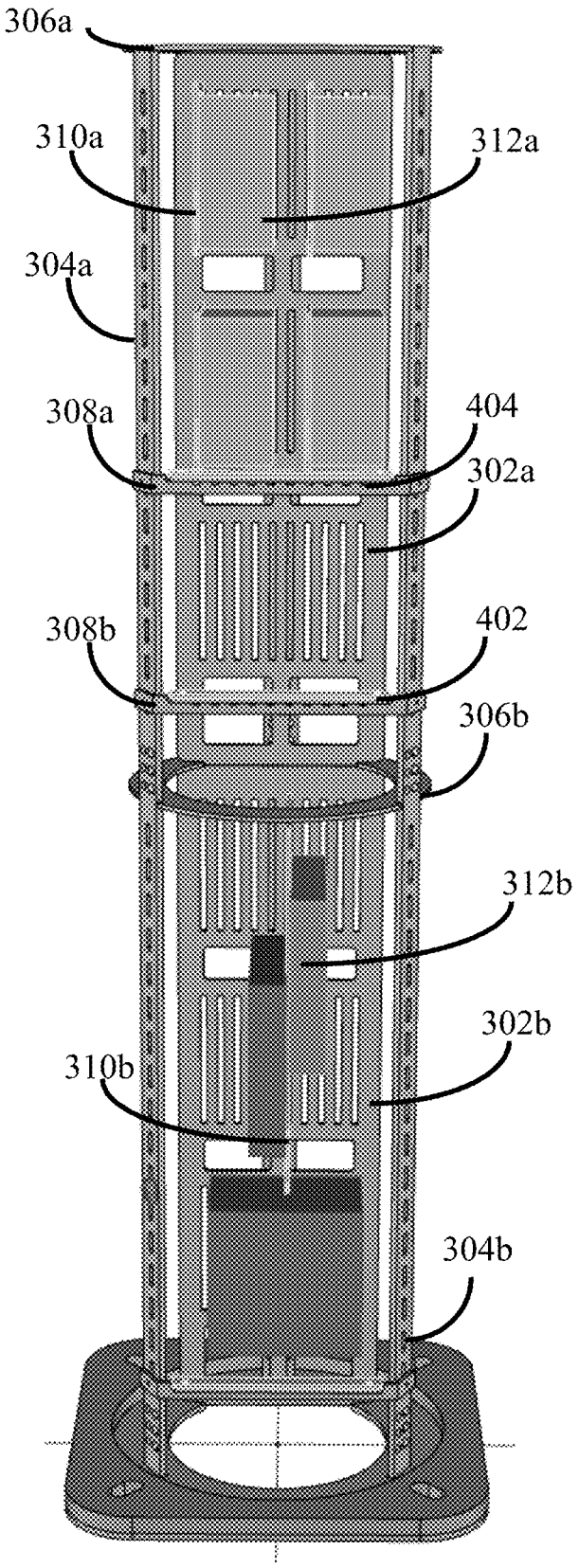
FIG. 17 is a front view of the small cell capsule of FIG. 16.
Figure 18:
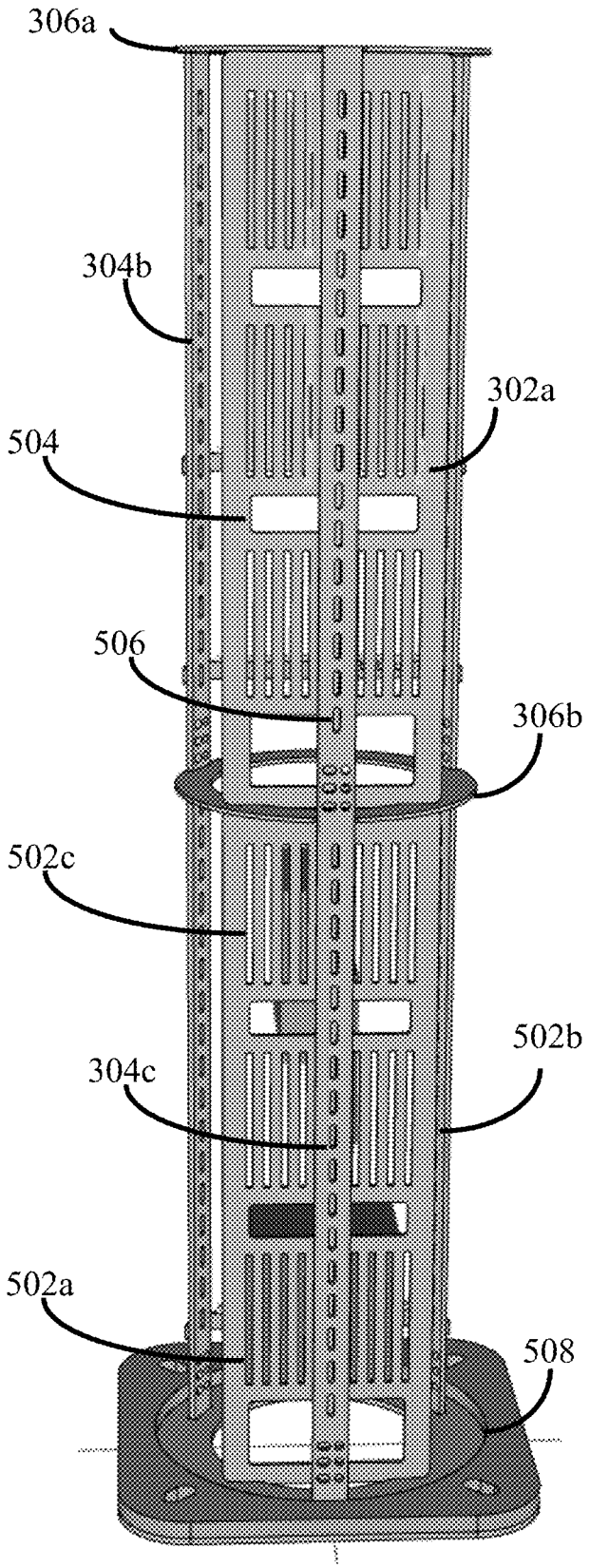
FIG. 18 is a rear view of the small cell capsule of FIG. 16.

FIGS. 16-18 provide exemplary views of the interior of a small cell capsule 100 with the pole structure 102 removed to illustrate the interior components of the small cell capsule 100.

The small cell capsule 100 is advantageously configured so as to fit within the small cell base 100*b* (in either the surface-mounted or embedded configuration). Small cell capsule 100 has an outer diameter that is smaller than the inner diameter of the base 100*a*. The outer diameter of the bottom of small cell capsule 100 is larger, however, than the inner diameter of the base 100*b* at seat 148 (as discussed above), so that when small cell capsule 100 is inserted into the base it is restricted from moving downward in the base when it comes into contact with seat 148.

As shown, the small cell capsule 100 includes a frame 300 made up of one or more backplanes 302*a* and 302*b*, vertical bars 304*a*, 304*b* and 304*c*, rings 306*a* and 306*b*, and front bars 308*a* and 308*b*. As shown, a first backplane 302*a* may be mounted above a second backplane 302*b*. A first ring 306*a* is located at the top of the first backplane 302*a*, while a second ring 306*b* is located at the top of the second backplane 302*b*. The vertical bars 304*a*, 304*b* and 304*c* are mounted perpendicularly to the rings 306*a* and 306*b* and are substantially parallel to one another and to the backplanes 302*a* and 302*b*. The vertical bars 304*a*, 304*b* and 304*c* may be comprised of one or more sections that are affixed together to form substantially continuous pieces. In an embodiment, two vertical bars 304*a* and 304*b* are located in front of the backplanes 302*a* and 302*b*, and a third vertical bar 304*c* is located behind the backplanes 302*a* and 302*b*. As shown, in an embodiment, the three vertical bars 304*a*, 304*b* and 304*c* are equidistantly spaced (e.g., 120 degrees apart, or other similar arrangement) around the perimeters of the rings 306*a* and 306*b*, with the backplanes 302*a* and 302*b* located within the rings 306*a* and 306*b*. For example, the three vertical bars 304*a*, 304*b* and 304*c* may be located at 0 degrees, 120 degrees, and 240 degrees, respectively. The vertical bars 304*a*, 304*b* and 304*c* function to support the weight of the frame 300 and any components attached to the frame 300, while the rings 306*a* and 306*b* provide lateral support and secure the vertical bars 304*a*, 304*b* and 304*c* to one another.

The one or more front bars 308*a* and 308*b* are removably secured to the one or more vertical bars 304*a* and 304*b* located in front of the backplanes 302*a* and 302*b* and are positioned so as to be substantially perpendicular to the vertical bars 304*a* and 304*b*. The backplanes 302*a* and 302*b* include one or more vertical slots 502 and the vertical bars include one or more apertures 506. In an embodiment, the backplanes 302*a* and 302*b* also include one or more horizontal openings 504.

In the embodiment shown, each backplane includes three sets of vertical slots 502, with three horizontal openings 504 interspersed vertically between the sets of vertical slots 502 (i.e., such that a horizontal opening 504 is located at the bottom of the backplane 302*a*, with a set of vertical slots 502 located above the horizontal opening 504, followed by another set of vertical slots 502, etc.). In an embodiment, each set of vertical slots 502 includes ten vertical slots 502 that are equidistantly spaced across the width of the backplane 302. Each vertical slot 502 is taller than it is wide, while each horizontal opening 504 is wider than it is tall. The vertical slots 502 and horizontal openings 504 extend entirely through the backplane 302 from front to back. Other arrangements of vertical slots 502 and horizontal openings 504 may also be used, as will be clear to one of skill in the art.

In an embodiment, a plurality of apertures 506 extends vertically along the height of each vertical bar 304. The apertures 506 are substantially centered on the vertical axis of each vertical bar 304 and extend from the bottom of each vertical bar 304 to the top of each vertical bar 304. The apertures 506 are spaced equidistantly between one another. Other arrangements and configurations of apertures 506 may also be used, as will be clear to one of skill in the art.

In an embodiment, the rings 306*a* and 306*b* are ⅜ of an inch thick. In an embodiment, the vertical bars 304*a* and 304*b* are 2 inches wide and ⅜ of an inch thick. In an embodiment, the base plate 202 is formed from a plate that is ¼ of an inch thick. In alternative embodiments, other thickness may be used depending on the particular materials used for the rings, vertical bars, and base plate and the associated structural and engineering requirements, as will be clear to one of skill in the art.

The frame 300 may be constructed using any suitable materials. In an embodiment, the frame 300 is comprised of metal alloys. Alternatively, the frame 300 may be comprised of one or more of pultruded fiberglass, aluminum, other metal alloys, composites, plastics and the like. In an embodiment, the frame 300 is comprised of an insulating material that is not conductive. In an alternative embodiment, at least a portion of the frame 300 is comprised of a material that is electrically conductive. In such an embodiment, at least a portion of the frame 300 may be used to supply a ground connection to electrical components affixed to the frame 300 (as discussed in greater detail below).

Any type of suitable fastener can be used to secure the various components of the frame 300 together, such as screws, bolts, rivets, pins or the like. Still further, other types of joining processes can be used to secure the sections of the frame 300 together such as welding, crimping, staking or the like. In the embodiment shown, six fasteners are used to connect segments of each vertical bar 304*a*, 304*b* and 304*c* together, such that a first segment of each vertical bar 304 extends from the flange 104 to a location proximate the second ring 306*b* and a second segment of each vertical bar 304 extends from the location proximate the second ring 306*b* to a location proximate the first ring 306*a*, thereby forming a substantially contiguous vertical bar 304. In an alternative embodiment, each vertical bar 304 is formed from a single segment that extends from the flange 104 to a location proximate the first ring 306*a*.

One or more cards 310*a* and 310*b*, each containing a component 312*a* and 312*b* (such as a radio, electric meter, distribution panel or other electrical or communication component for the small cell 100) are removably mounted to the frame 300, as discussed in greater detail below.

In an embodiment, the pole structure 102 is connected to the frame 300. In an embodiment, the pole structure 102 is fastened to one or more of the vertical bars 304. In an alternative embodiment, the pole structure 102 is structurally distinct from the frame 300. The circumference of the frame 300 is less than the interior circumference of the pole structure 102, such that the frame 300 may be located entirely within the pole structure 102. Foam, spacers or other materials can also be used to isolate the frame 300 from the pole structure 102 to prevent the frame 300 from vibrating or moving radially inside of the pole structure 102.

In an embodiment, the backplanes 302 are aligned with the openings 106 in the pole structure 102, such that the front face of each backplane 302 is accessible through the openings 106. This enables a technician located outside the pole structure 102 to readily access the front face of each backplane 302, for example, to mount or dismount cards 310 from the backplanes 302.

Figure 36:
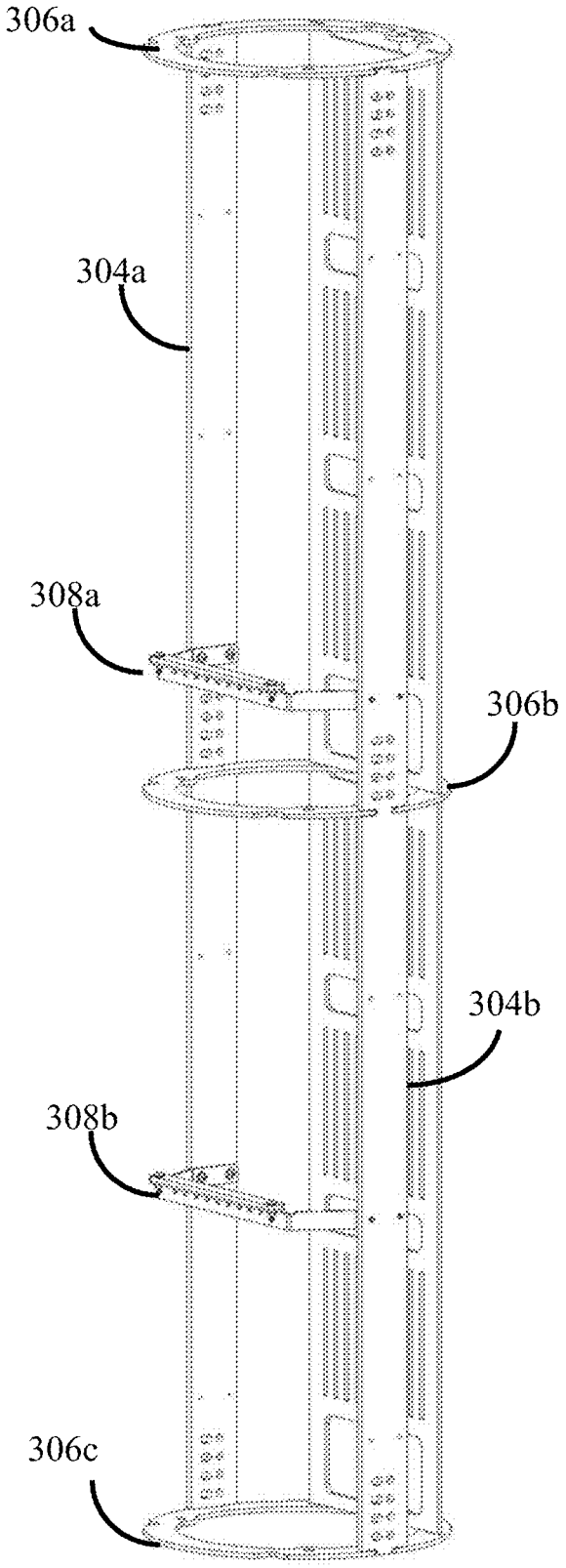
FIG. 36 is a front perspective view of the interior of another embodiment of a small cell capsule located within the small cell pole structure of FIG. 14 with the pole structure removed.
Figure 37:
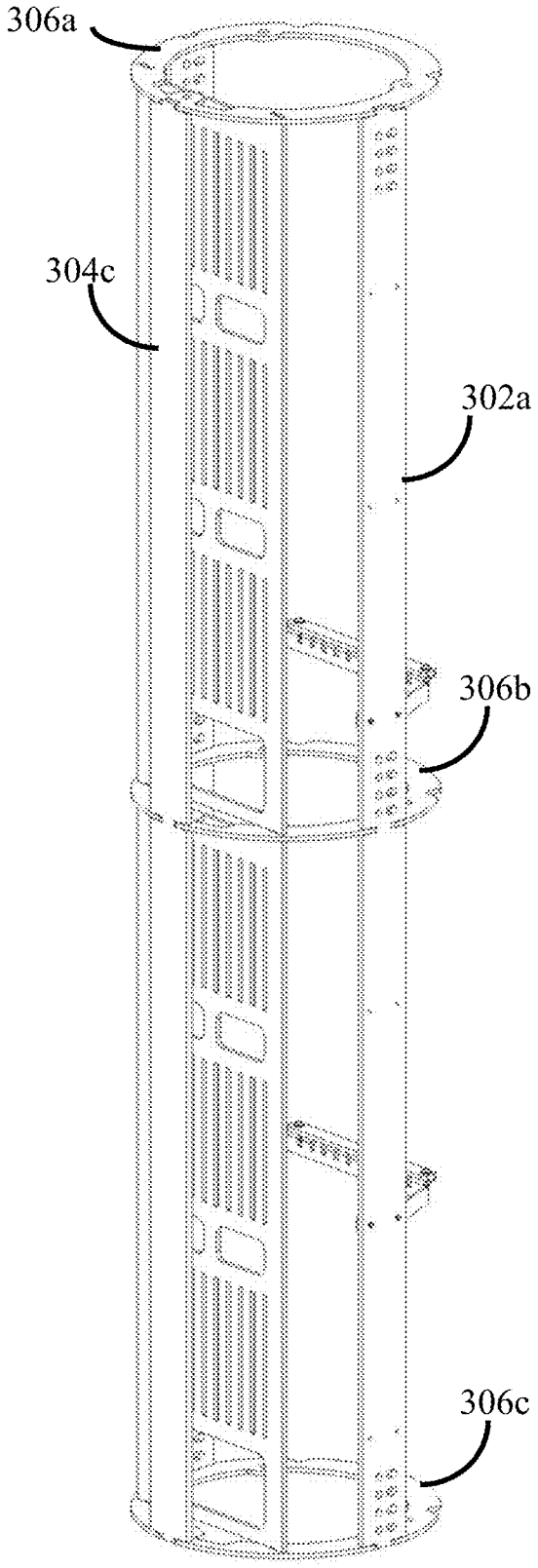
FIG. 37 is a rear perspective view of the small cell capsule of FIG. 36.

In the alternative embodiment shown in FIGS. 36 and 37, the vertical bars 304*a*, 304*b* and 304*c* are not equidistantly spaced from one another. Vertical bar 304*c* is located at 0 degrees, while vertical bars 304*b* and 304*a* are located at 90 degrees and 270 degrees, respectively. This arrangement advantageously allows for easier access to the interior of the capsule. In an embodiment, an additional ring 306*c* is located at the bottom of the frame 300. The ring 306*c* may be secured to the base plate 202.

Figure 38:
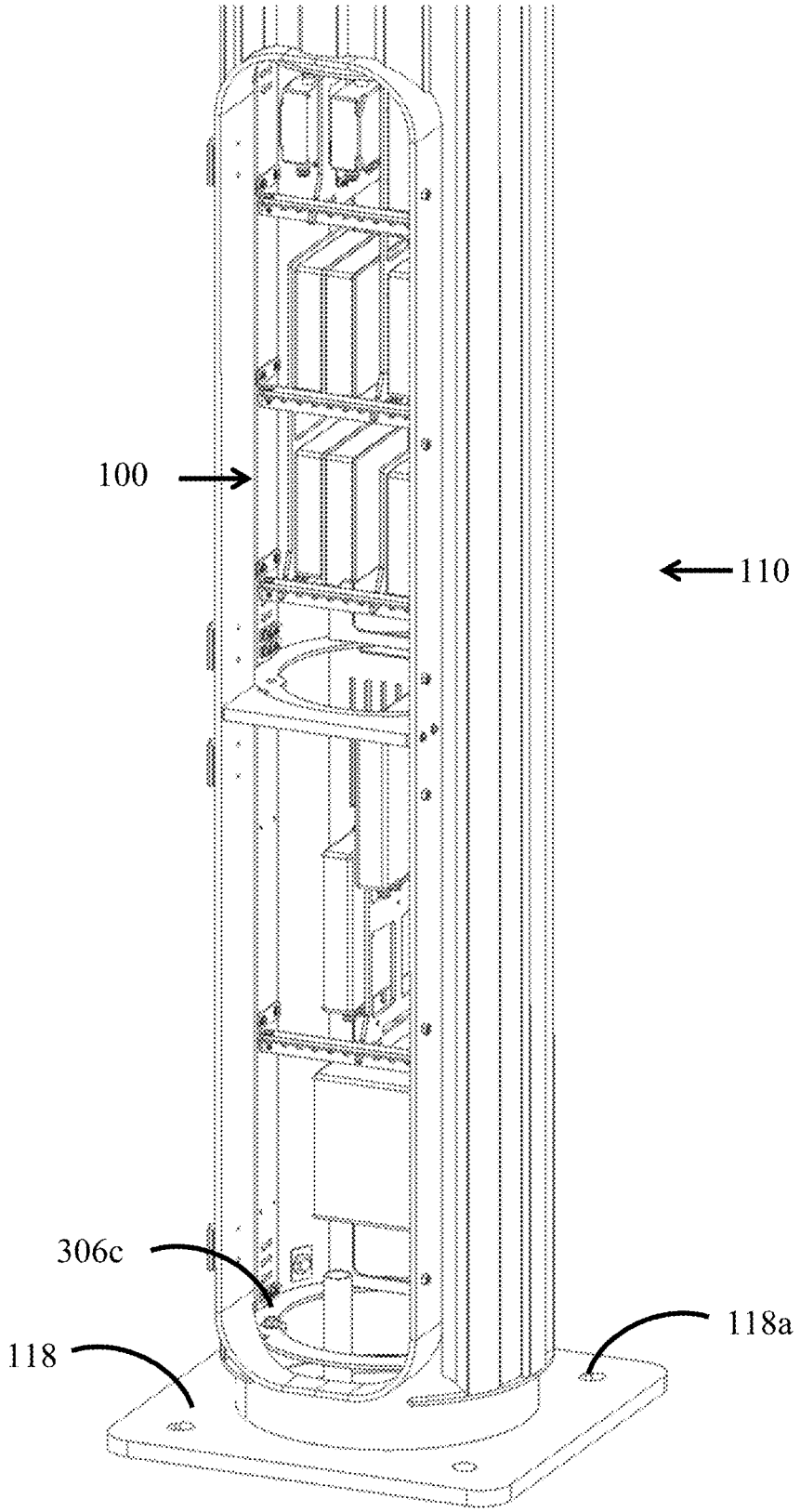
FIG. 38 is a perspective view of the small cell capsule of FIG. 36 with the pole structure in place.

FIG. 38 depicts the small cell capsule 100 of FIGS. 36 and 37 within the surface-mounted base 110. As shown, the lower ring 306*c* rests upon the seat 116.

In an alternative embodiment, the small cell capsule omits the vertical bars and rings; in this embodiment, the capsule is formed of a backplane (that may be generally similar to backplane 302) and one or more front bars (that may be generally similar to front bar 308) that are connected directly to the interior surface of the base. The base may include one or more premade holes or openings to receive fasteners used to secure the capsule to the base. Alternatively, the backplane and/or front bars may be welded or otherwise permanently attached to the base. This embodiment advantageously simplifies the construction of the capsule, reduces the amount of materials required to form the capsule, and may reduce the amount of time and labor required in advance of installation of the capsule in the small cell pole system (which can substantially reduce the associate cost). Similarly, the elements forming the capsule may be shipped more conveniently.

Figure 19:
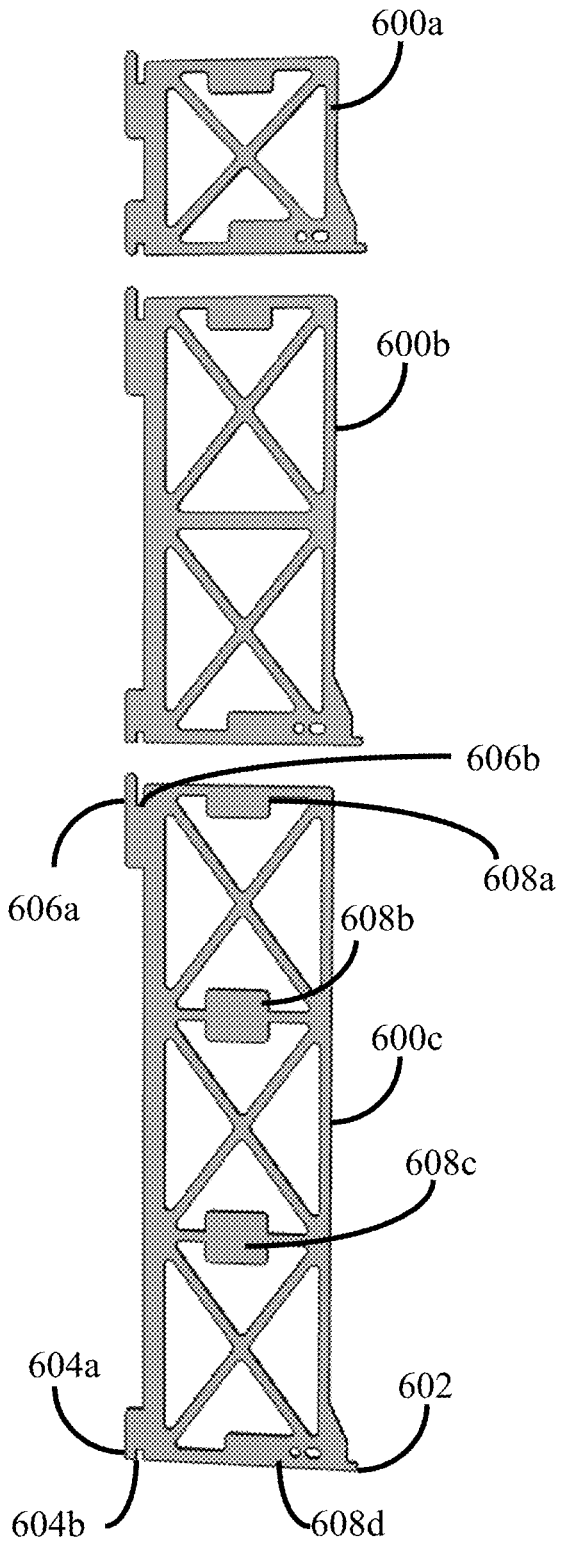
FIG. 19 is a side view of three cards in accordance with an embodiment of the present invention.

FIG. 19 depicts a plurality of cards 600 that are each substantially similar to card 310, except as otherwise noted. As shown, the various sizes of cards 600 may be used with the frame 300 so as to attach components 312 of varying sizes to the frame. Each card includes a front protrusion 602, a rear protrusion 604*a*, a rear notch 604*b*, a top protrusion 606*a* and a top notch 606*b*. Each card 600 also includes a plurality of plates 608*a*, 608*b*, 608*c* and 608*d*. The top protrusion 606*a*, top notch 606*b*, rear protrusion 604*a* and rear notch 606*b* are sized so as to removably engage with the vertical slots 502 in a backplane 302 (i.e., the thickness of the protrusions 604*a* and 606*a* is less than the width of the vertical slots 502, and the width of each notch 604*b* and 606*b* is greater than the thickness of the backplane 502).

For a single-height card 600*a*, the top protrusion 606*a* and the rear protrusion 604*a* engage with a single vertical slot 502. For a double-height card 600*b*, the rear protrusion 604*a* engages with a first vertical slot 502*a* and the top protrusion 606*a* engages with a second vertical slot 502*b*, located adjacent to and above the first vertical slot 502*a*. For a triple-height card 600*c*, the rear protrusion 604*a* engages with a first vertical slot 502*a* and the top protrusion 606*a* engages with a third vertical slot 502*c*, located at the opposite end of the backplane 302 from the first vertical slot 502*a*. The plates 608 serve to attach the card to a component 312 of the small cell 100, such as a radio, electrical meter, distribution panel, etc. One or more components 312 may be mounted to each card 600. The particular card 600*a*, 600*b* and 600*c* may be selected so as to suitably accommodate a component (i.e., a taller component would be mounted to a double-height card 600*b* or a triple-height card 600*c*, while a shorter component would be mounted to a single-height card 600*a*). Other sizes of cards 600 may also be used, so long as the protrusions 604*a* and 606*a* are able to engage with slots 502 on a backplane 302.

When mounted to the frame 300, the top protrusion 606*a* and the rear protrusion 604*a* engage with a backplane 502, while the front protrusion 602 engages with the front bar 308. Each front bar 308 includes one or more holes 404 sized to accommodate the front protrusion 602 (i.e., each front protrusion 602 is slightly smaller than the one or more holes 404). The holes 404 are arranged to correspond with the vertical slots 502 in the backplanes 302 (i.e., each hole 404 is substantially aligned with the bottom of a particular vertical slot 502). Each front bar 308 is connected to two vertical bars 304*a*, 304*b* so as to be located proximate the lower edge of a set Each front bar 308 is connected to two vertical bars 304*a* and 304*b* so as to be located proximate the lower edge of a set of vertical slots 502. A locking bar 402 may then be fastened along the upper surface of the front bar 308 to securely attach the card 600 to the frame 300 while still enabling the card to be easily removed from the frame.

Figure 20:
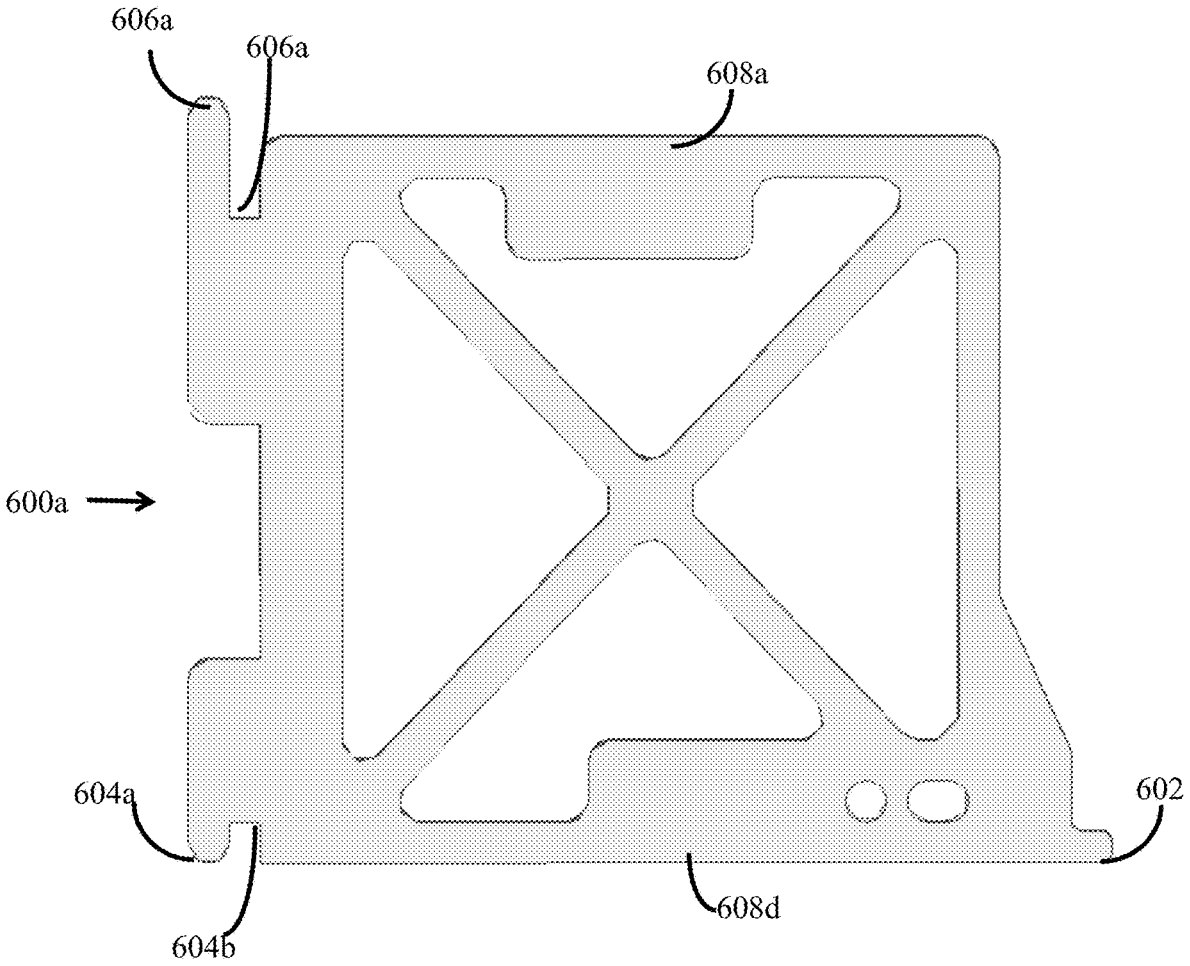
FIG. 20 is a detailed view of one of the cards of FIG. 19.

FIG. 20 provides a detailed view of the structure of a single card 600*a*, which is generally similar to the card 600*a* depicted in FIG. 19.

Figure 21:
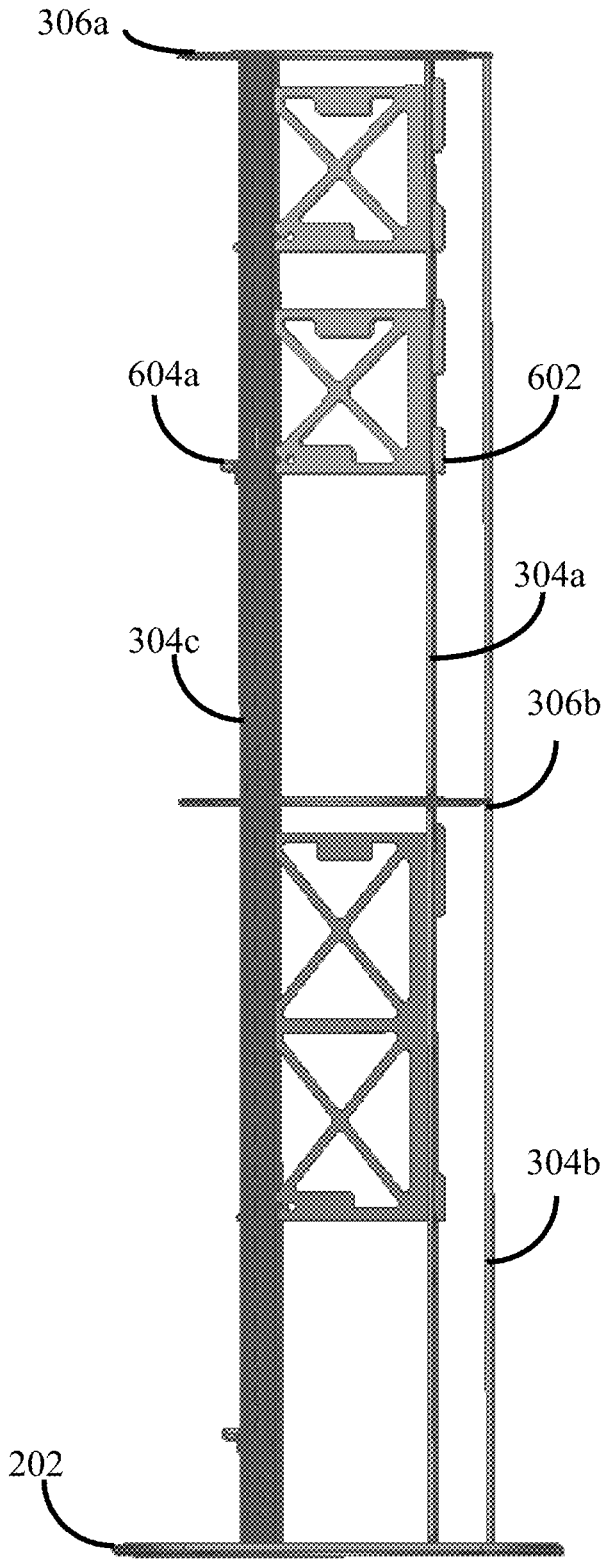
FIG. 21 is a side view of a small cell capsule depicting empty cards inserted into a backplane, in accordance with an embodiment of the present invention.
Figure 22:
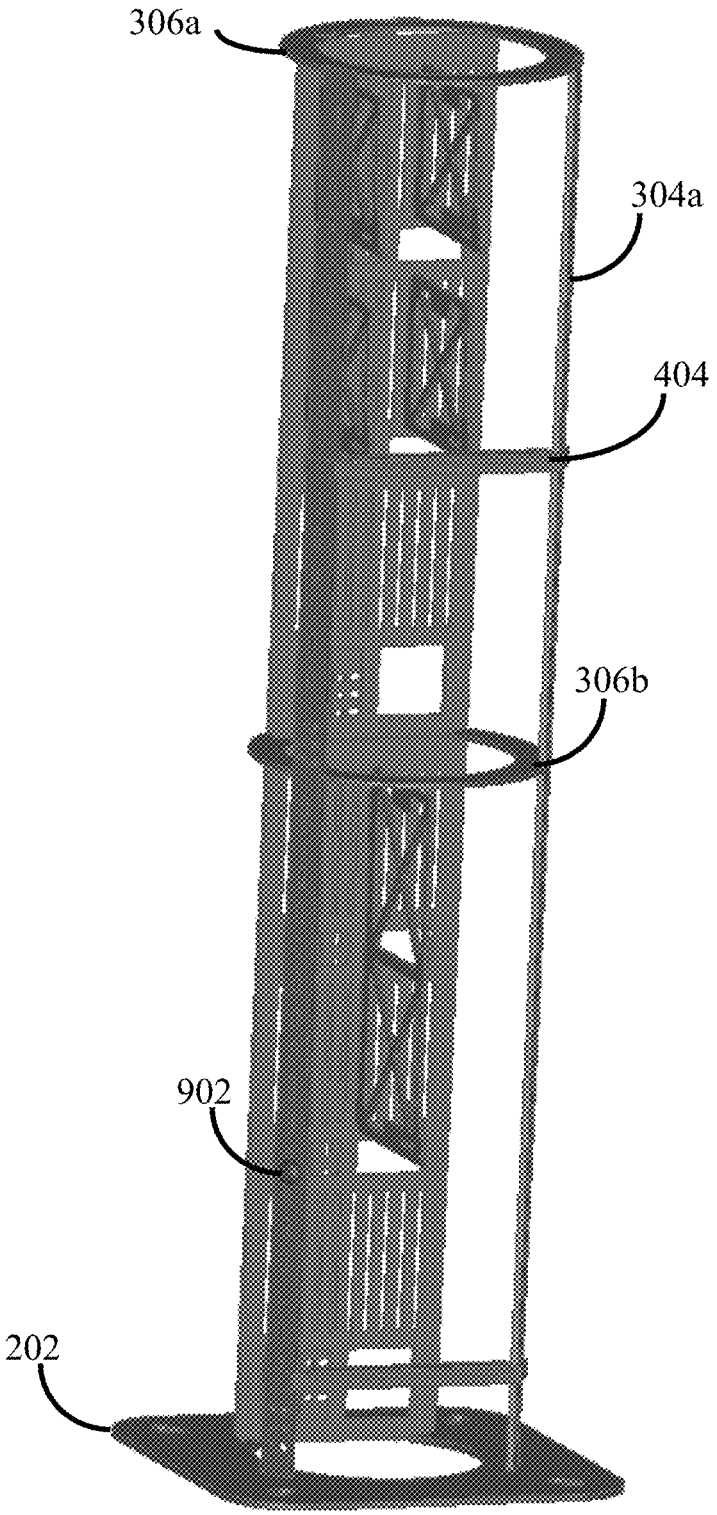
FIG. 22 is a perspective view of the small cell capsule of FIG. 21.

FIGS. 21 and 22 provide perspective views of a small cell capsule including a plurality of cards mounted without equipment for illustrative purposes. As shown in FIG. 22, in an embodiment, one or more bumpers 902 may be attached to the vertical bars 304 so as to insulate the frame 300 from the pole structure 102 and ensure that the frame 300 is not vibrated or moved laterally by forces exerted on the pole structure 102.

Figure 23:
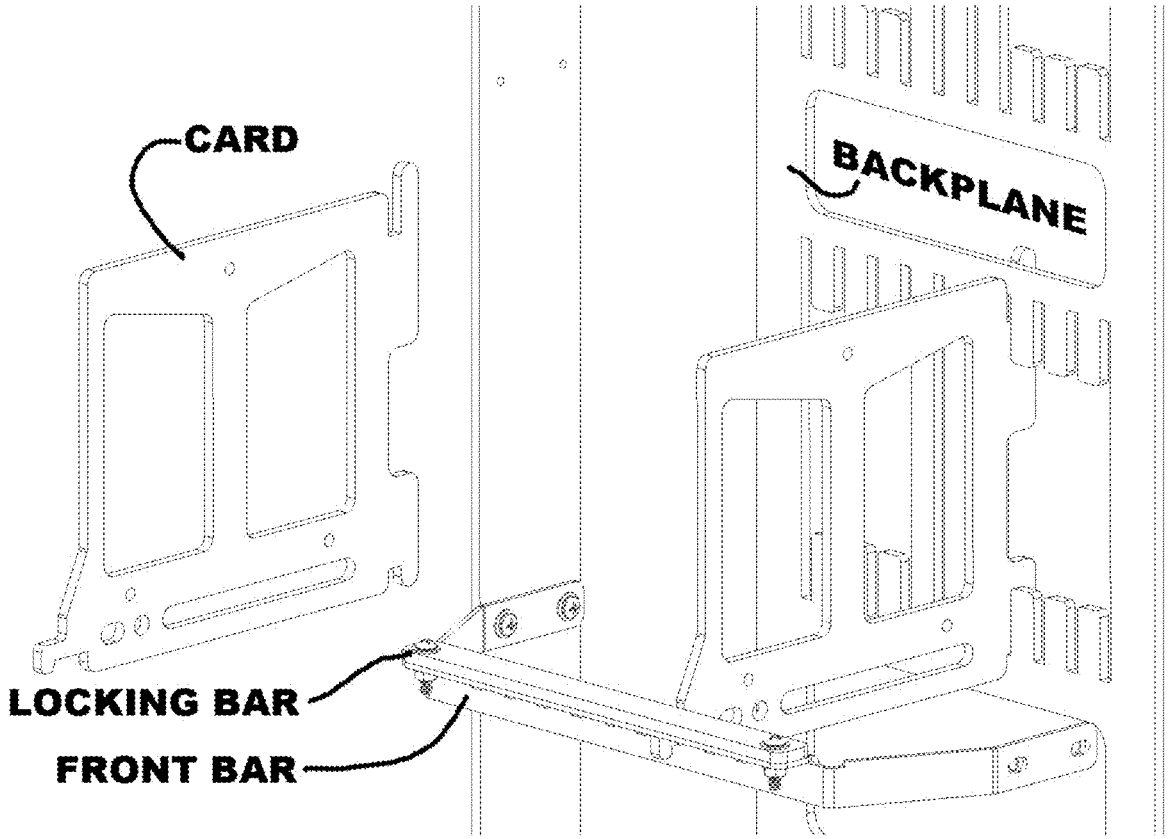
FIG. 23 is an illustration of cards inserted into a backplane in accordance with an embodiment of the present invention.

FIG. 23 provides an illustration of another embodiment of a card, locking bar, front bar and backplane. As shown, a radio (such as a 2208 radio) is mounted to the card. The card is then inserted into a vertical slot in the backplane and a hole in the front bar, before the locking bar is affixed to the front bar, securing the card in place.

Figure 24:
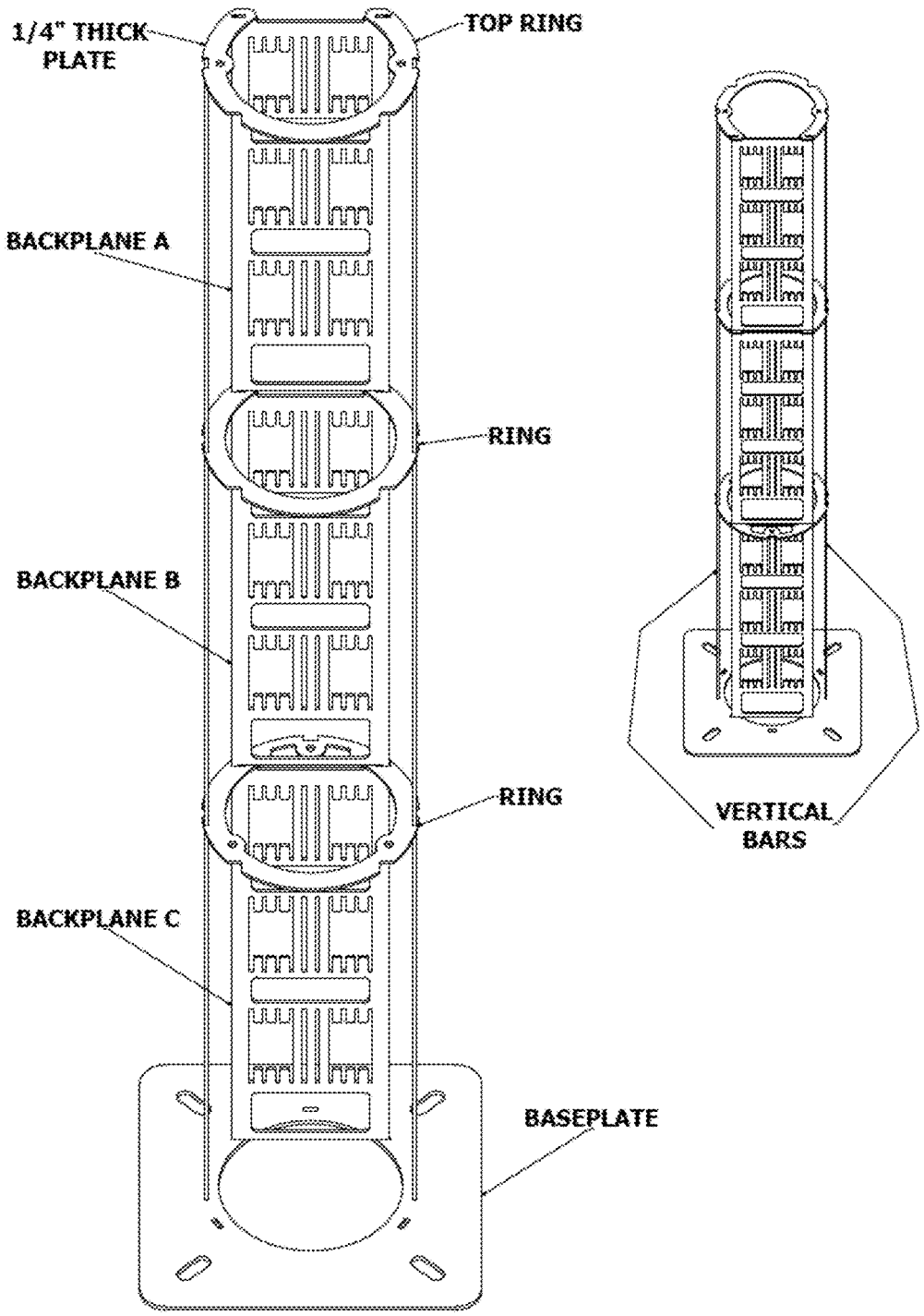
FIG. 24 is an illustration of a backplane, a base plate and three rings in accordance with an embodiment of the present invention.

FIG. 24 provides an illustration of a plurality of backplanes (backplanes "A," "B" and "C") interspersed with a plurality of rings.

The foregoing elements of the small cell system provide a robust, efficient and economical solution for adding capacity and coverage to a communication system. The installation of components in the small cell system provides many advantages. The installation process of the small cell system is particularly advantageous. The method of installation will now be explained.

Figure 25:
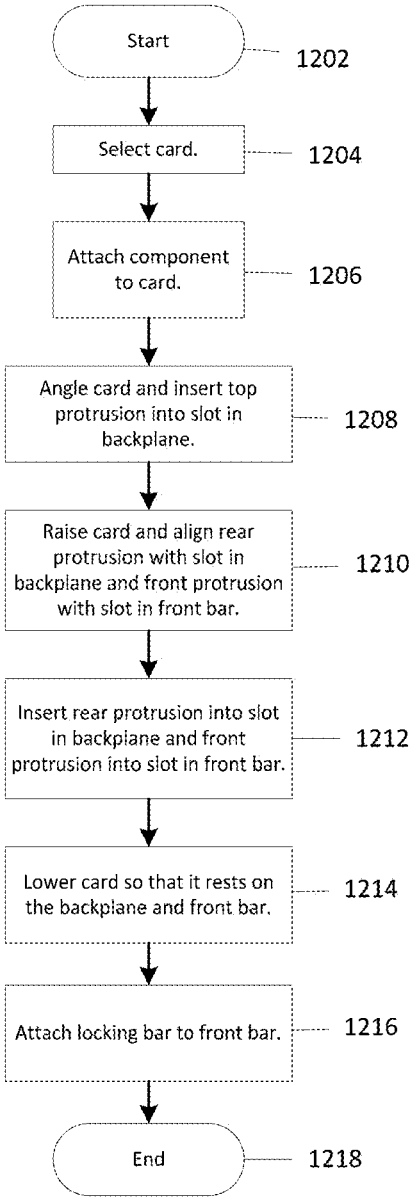
FIG. 25 is a flowchart illustrating a method of installing a card in accordance with an embodiment of the present invention.

FIG. 25 is a flowchart generally depicting the steps involved in the method of installing a card 600, as illustrated in FIGS. 26*a*-26*d*. In step 1204, a card is selected based on the particular component to be installed in the small cell capsule. The card must be of an appropriate size so as to effectively support the component. In step 1206, the component is attached to the selected card. In step 1208, the card is angled, and the top protrusion is inserted into a slot in the backplane. In step 1210, the card is raised, and the rear protrusion is aligned with the bottom of the slot in the backplane, while the front protrusion is aligned with a hole in the front bar. In step 1212, the rear protrusion is inserted into the slot in the backplane, and the front protrusion is inserted into the slot in the front bar. In step 1214, the card is lowered so that it rests on the backplane and the front bar.

In step 1216, a locking bar is attached to the front bar in order to secure the card in place.

Method of Installing Card

FIGS. 26*a*-26*d* depict detailed illustrations of a method for installing a card 600 in a frame 300. At step 1, a technician selects an appropriate card 600*a*, 600*b* and 600*c* based on the specific component 312 to be installed. At step 2, the technician secures the card 600 to the component 312 using suitable fasteners (such as screws, bolts, rivets or other suitable fasteners).

Figure 26A:
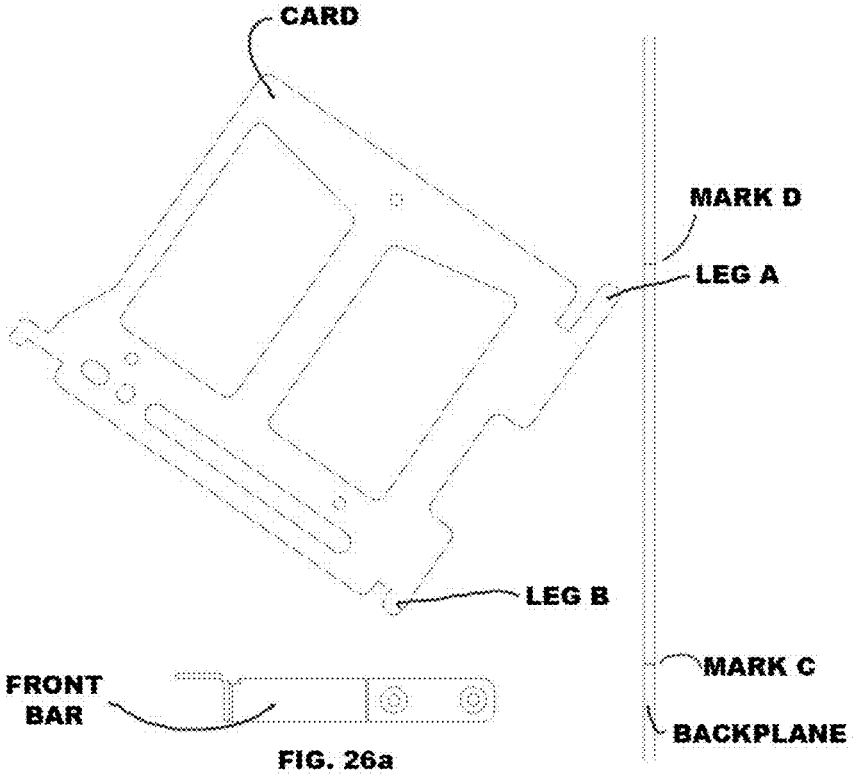
FIGS. 26*a*-26*d* are illustrations of a method for inserting a mounting bracket into a backplane in accordance with an embodiment of the present invention.

As shown in FIG. 26*a*, at step 3, the technician angles the card 600 backward such that the top protrusion is located proximate a vertical slot 502 in a backplane 302 and the card 600 is aligned with the vertical slot 502. The technician then inserts the top protrusion 606*a* (denoted as "Leg A") into the vertical slot 502. The technician may accomplish this while standing outside the pole structure 102 by reaching through an opening 106 that corresponds to the desired backplane 302.

Figure 26B:
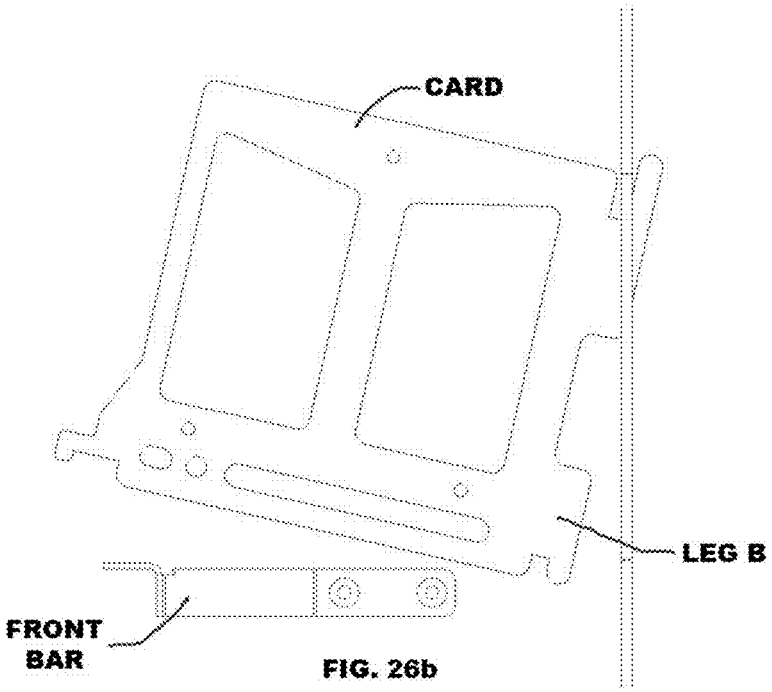

As shown in FIG. 26*b*, at step 4, once the top protrusion 606*a* is inserted into the vertical slot 502, the technician raises the card 600 such that the top notch 606*b* is proximate the top edge of the vertical slot 502 while aligning the rear protrusion 604*a* with the bottom of the vertical slot 502. The technician then tilts the card 600 forward while inserting the bottom protrusion through the vertical slot 502.

Figure 26C:
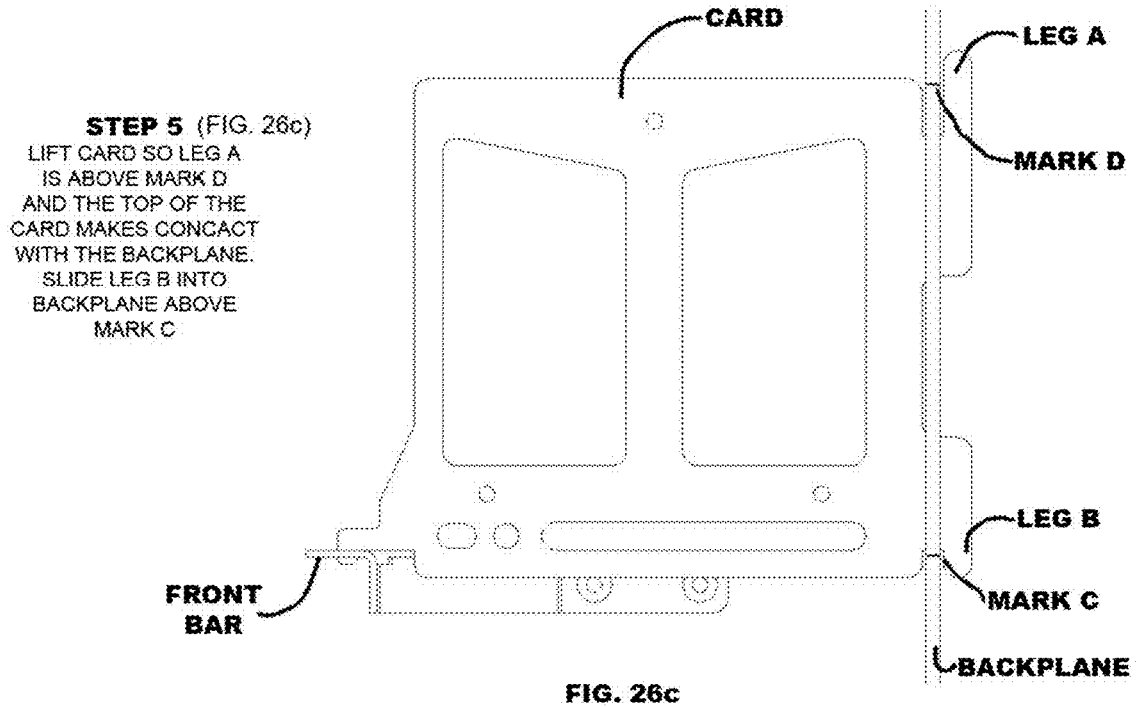

As shown in FIG. 26*c*, at step 5, the technician raises the card 600 such that the top notch 606*b* makes contact with the top edge of the vertical slot 502, while aligning the front protrusion 602 with the corresponding hole 404 in the front bar 308. The rear notch 604*b* is also aligned with the backplane 302.

Figure 26D:
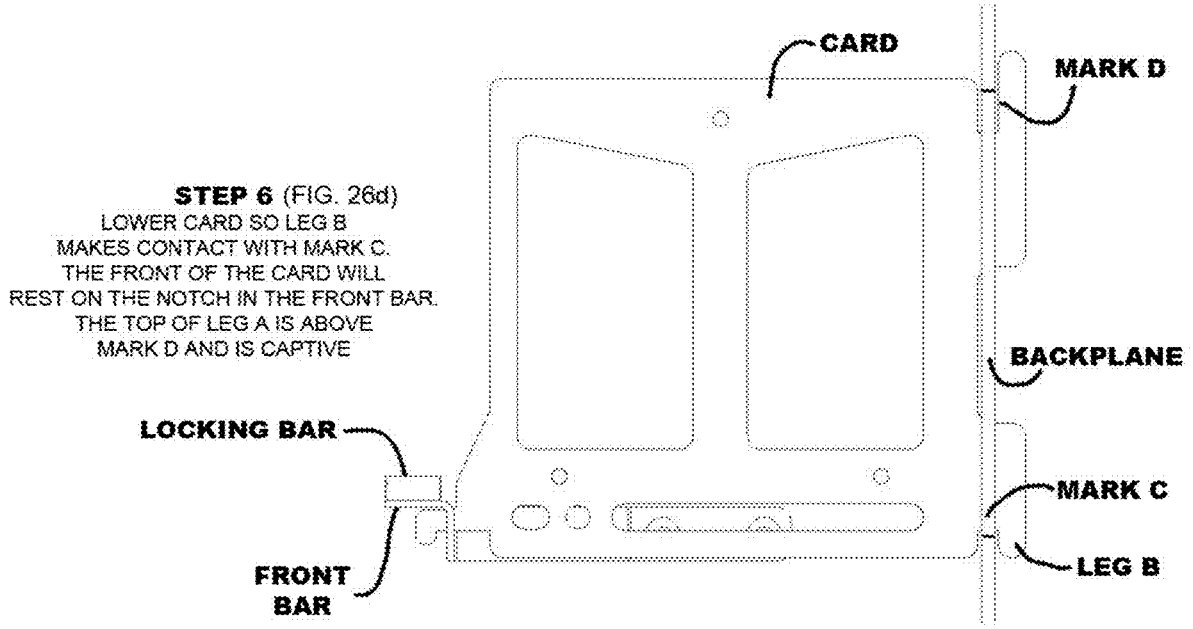

As shown in FIG. 26*d*, in step 6, the technician lowers the card 600 so that the rear notch 604*b* contacts the bottom edge of the vertical slot 502 and the front protrusion 602 rests within the hole 404 in the front bar 308. The locking bar 402 is then fastened to the front bar 308 over the front protrusion 602, securing the card in place.

To remove a card 600, the above process is reversed. The locking bar 402 is removed, the card 600 is lifted and tilted backwards so that the front protrusion 602 is removed from the hole 404 and the rear protrusion 604*a* disengages from the vertical slot 502, and the card 600 is then pulled away from the backplane 302.

In an embodiment, the hole 404 is located solely on a top surface of the front bar 308. The front protrusion 602 is thus lowered through the hole such that the bottom of the card 600 rests on the top of the front bar 308. In an alternative embodiment, the hole 404 extends through both the top surface and the back surface of the front bar 308, such that the card 600 rests on the hole 404. In an embodiment, the front protrusion 602 extends both forward and downward from the card (as shown, for example, in FIGS. 26*a*-26*d*) such that the card 600 cannot move either vertically or transversely once the front protrusion 602 is secured in the hole 404.

Figure 27:
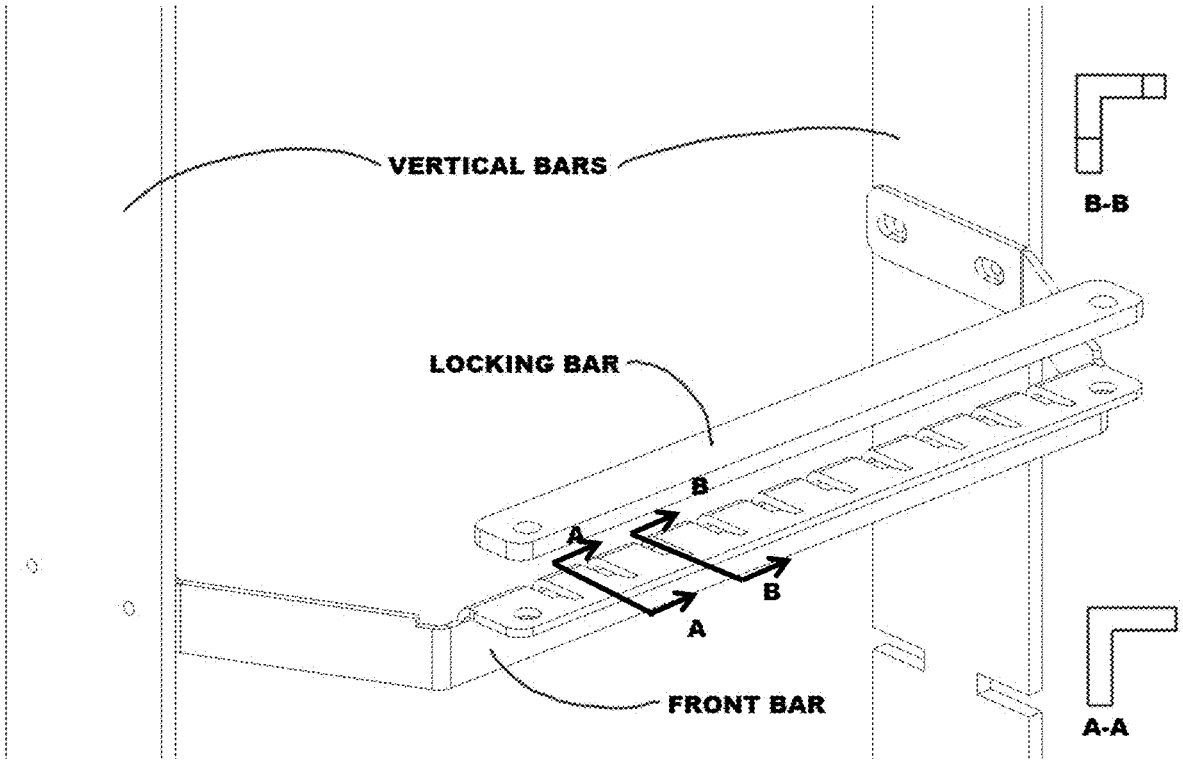
FIG. 27 is an illustration of a front bar and locking bars in accordance with an embodiment of the present invention.

FIG. 27 illustrates an embodiment of the structure of the front bar 308. As shown, the front bar 308 is secured to a pair of vertical bars 304*a* and 304*b* and extends perpendicularly between the vertical bars 304*a* and 304*b*. The front bar 308 includes a plurality of holes 404 or notches to permit the front protrusion 602 of a card 600 to be inserted into the front bar 308. One or more locking bars 402 may be secured to the front bar 308, for example by inserting a bolt through a preexisting orifice in the front bar. As shown in cross-sectional views A-A and B-B, the front bar has an L-shaped cross section in an embodiment, such that it comprises a top surface and a rear surface.

In an embodiment, the backplane 302 and/or the front bar 308 provides an electrical connection to a card 600. In an embodiment, the entire backplane 302 serves as an electrical ground. In an embodiment, the front bar 308 provides power to the card 600. In this embodiment, the front bar 308 is electrically isolated from the backplane 302.

Figure 28A:
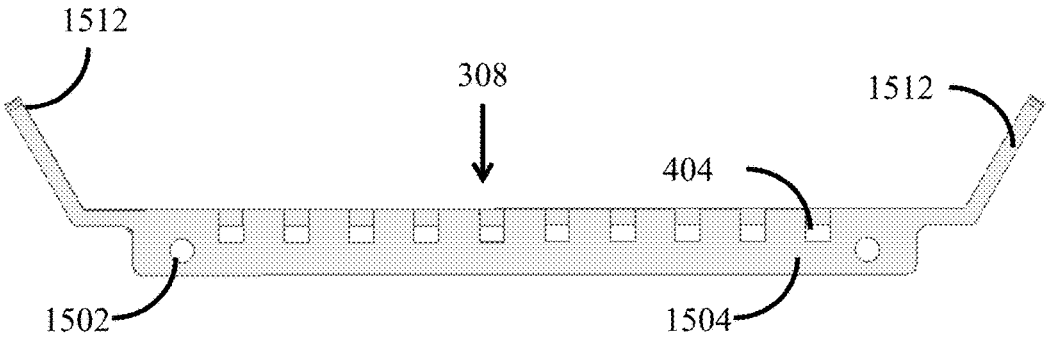
FIGS. 28*a*-28*c* are detailed views of a front bar in accordance with an embodiment of the present invention.
Figure 28B:
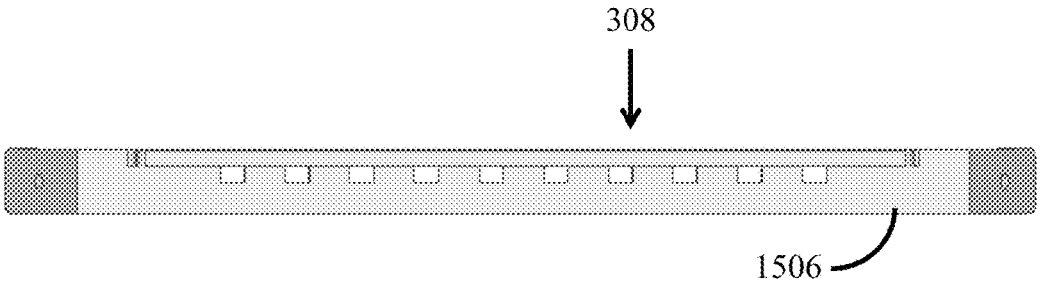
Figure 28C:
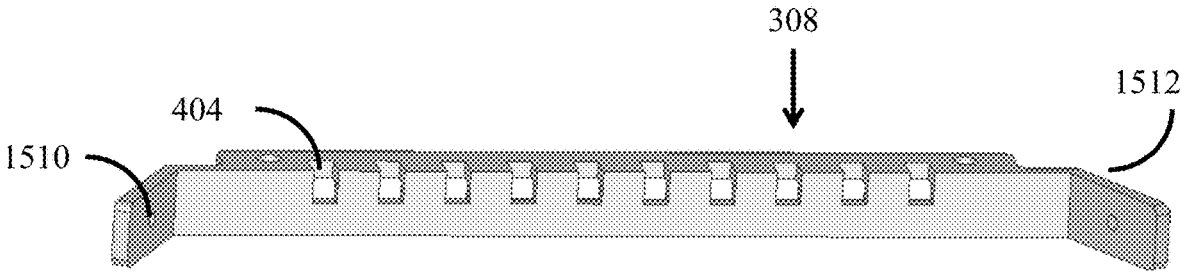

FIGS. 28*a*-28*c* provide detailed views of a front bar 308 in accordance with an embodiment of the present invention. As shown, the front bar 308 comprises a vertical surface 1506 and a horizontal surface 1504 joined at a right angle. The front bar includes two flanges 1512, which are angled so as to align and be connected to the vertical bars 304*a* and 304*b*. Each flange 1512 contains one or more openings 1510 to enable the front bar 308 to be easily attached to the vertical bars 304*a*, 304*b* using a fastener. The horizontal surface includes one or more openings 1502 to enable a locking bar 402 to be affixed along the horizontal surface of the front bar 308. One or more holes 404 are made in the front bar 308 to receive the front protrusion 602 of a card 600. In an embodiment, the holes 404 are formed in both the vertical surface 1506 and the horizontal surface 1504, such that a front protrusion 602 may be lowered through the hole in the horizontal surface 1504 and rest in the notch formed in the vertical surface 1506, such that the front protrusion 602 is substantially flush with the horizontal surface 1504.

Figure 29A:
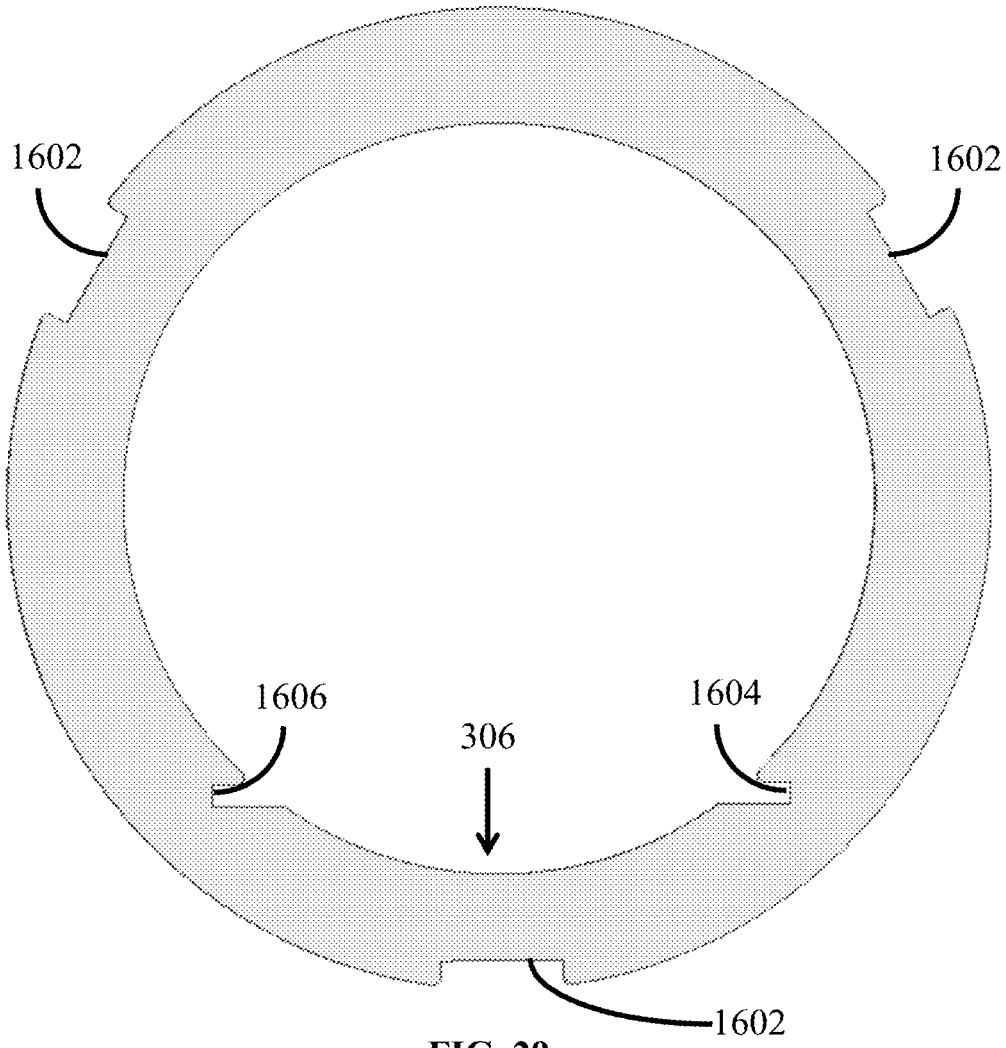
FIGS. 29*a* and 29*b* are detailed views of rings in accordance with an embodiment of the present invention.
Figure 29B:
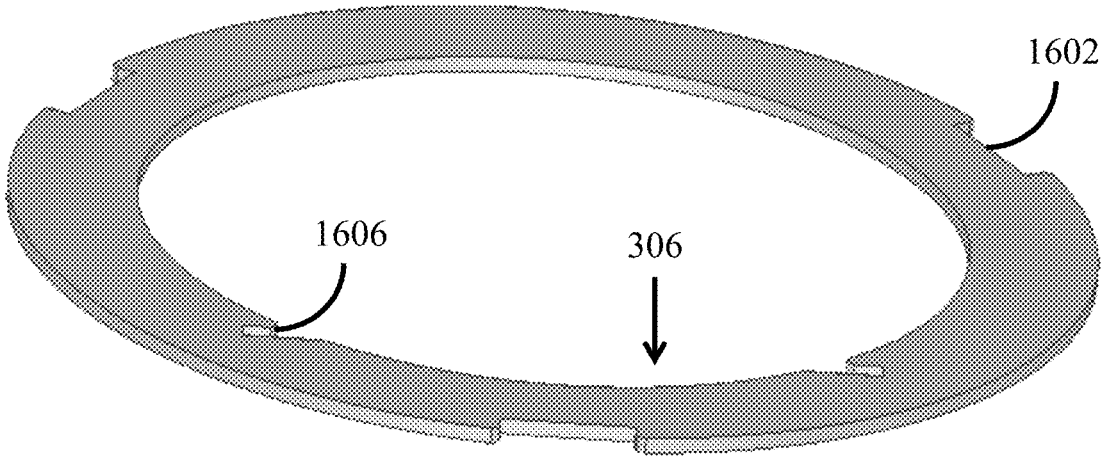

FIGS. 29*a* and 29*b* provide detailed views of a ring 306 in accordance with an embodiment of the present invention. As shown, the ring 306 is substantially circular. Three notches 1602 are located in the outer circumference of the ring 306. These notches 1602 are positioned and sized so as to accommodate the vertical bars 304. A pair of notches 1604 and 1606 are located in the inner circumference of the ring 306 and are sized so as to accommodate the lateral sides of the backplane 302.

Figure 30:
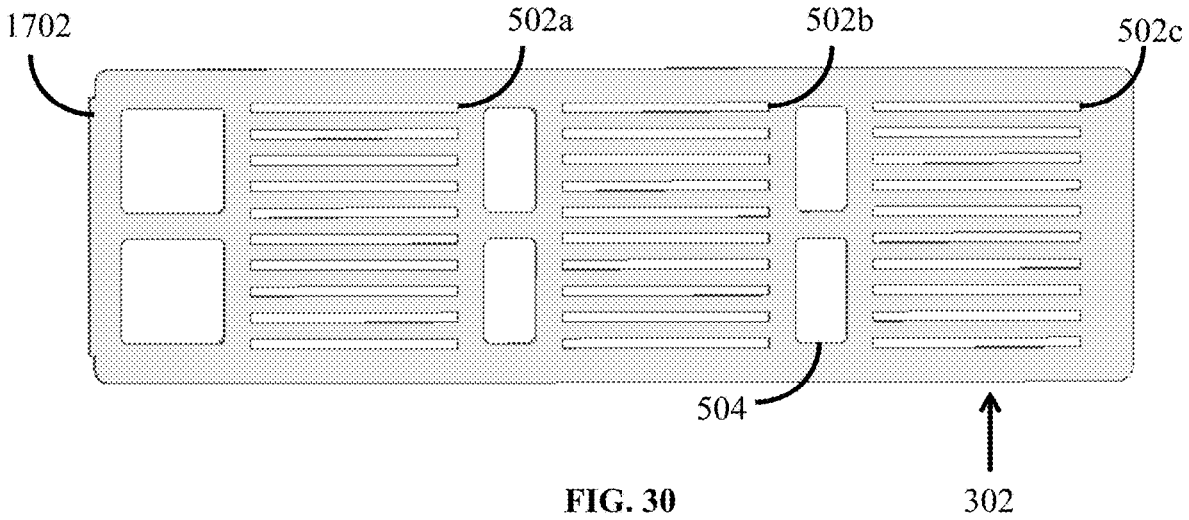
FIG. 30 is a detailed view of a backplane in accordance with an embodiment of the present invention.

FIG. 30 provides a detailed view of a backplane 302 in accordance with an embodiment of the present invention. As shown, in an embodiment, the backplane includes a protrusion 1702 sized so as to fit into a corresponding notch in the base plate 202.

Figure 31:
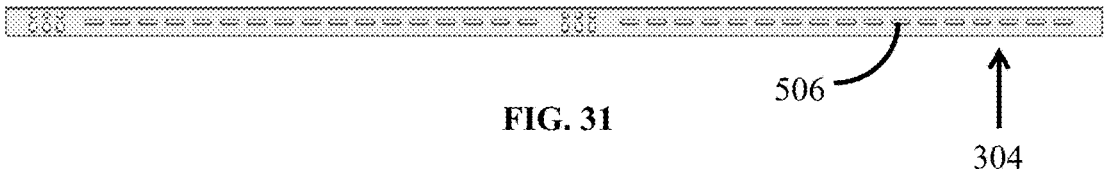
FIG. 31 is a detailed view of a vertical bar in accordance with an embodiment of the present invention.

FIG. 31 provides a detailed view of a vertical bar 304 in accordance with an embodiment of the present invention. As shown, a series of openings 506 run substantially the length of the vertical bar 304.

Figure 32:
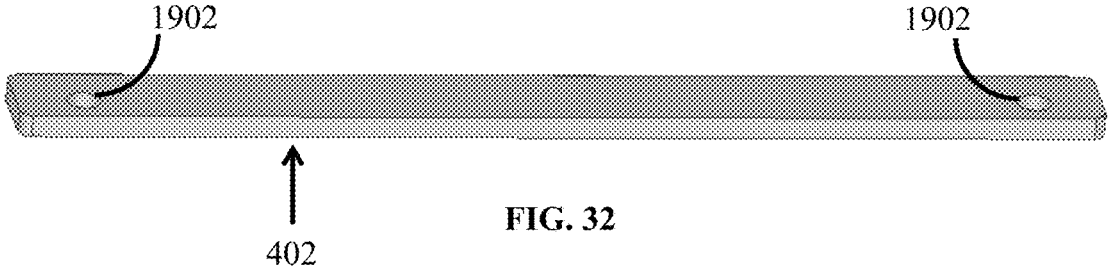
FIG. 32 is a detailed view of a locking bar in accordance with an embodiment of the present invention.

FIG. 32 is a detailed view of a locking bar 402 in accordance with an embodiment of the present invention. As shown, the locking bar 402 comprises a pair of openings 1902 to permit fasteners to be inserted through the locking bar 402 in order to secure the locking bar 402 to a front bar 308.

Figure 33A:
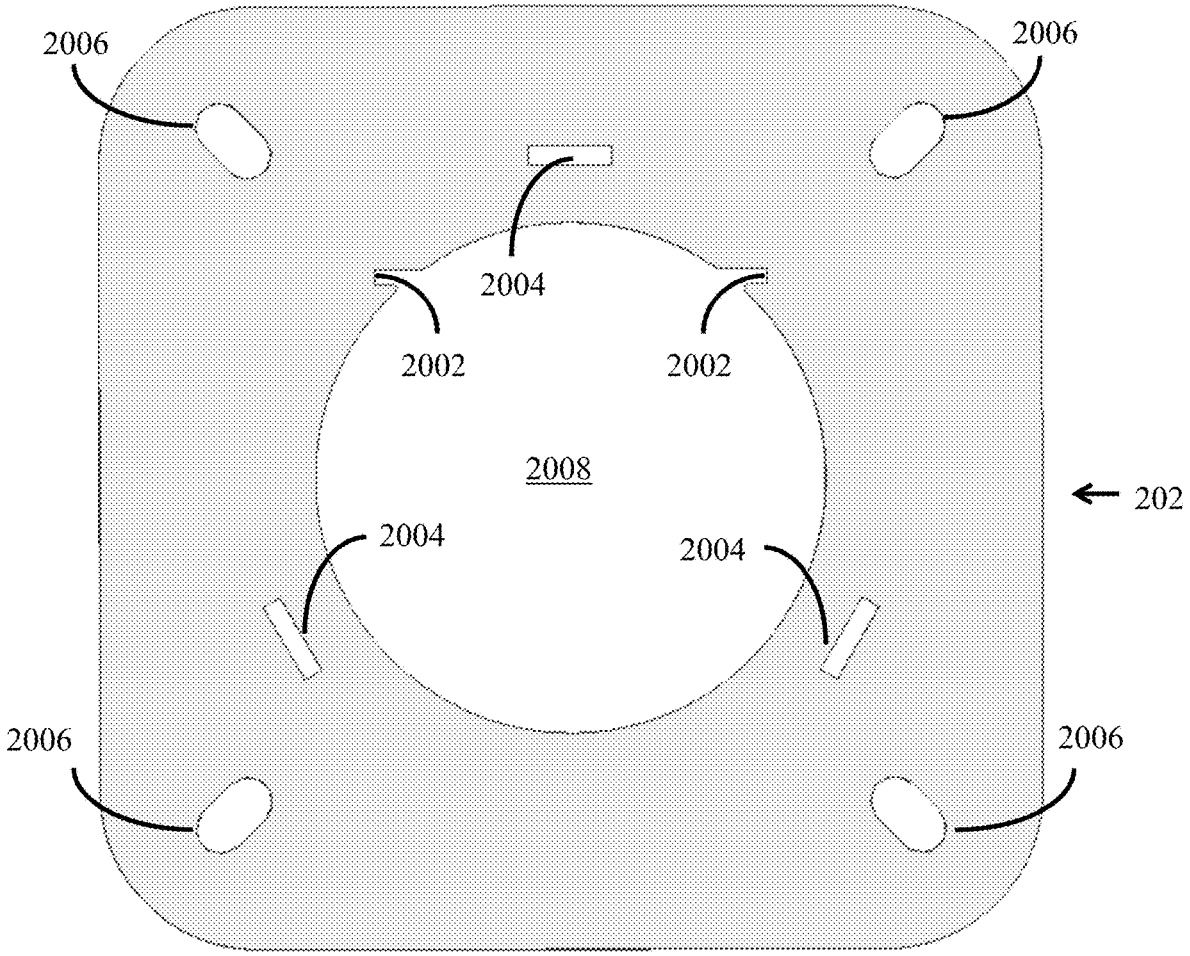
FIGS. 33*a* and 33*b* are detailed views of a base plate in accordance with an embodiment of the present invention.
Figure 33B:
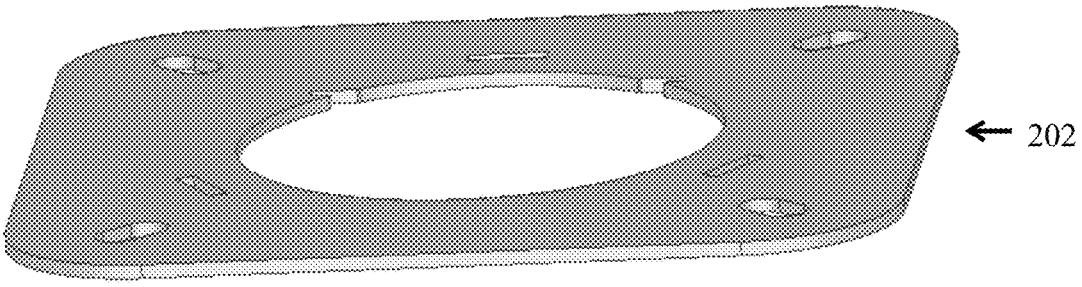

FIGS. 33*a* and 33*b* are detailed views of a base plate 202 in accordance with an embodiment of the present invention. The base plate 202 is substantially rectangular in cross section. Four openings 2006 located in the corners of the base plate 202 allow the base plate 202 to easily be secured to a surface, such as the ground. A substantially circular cutout 2008 is located in the center of the base plate 202, with two notches 2002 sized and located so as to hold the bottom edge of a backplane 302. Three notches 2004 located around the circular cutout 2008 are sized and located so as to support the lower edges of the vertical bars 304.

Figure 34:
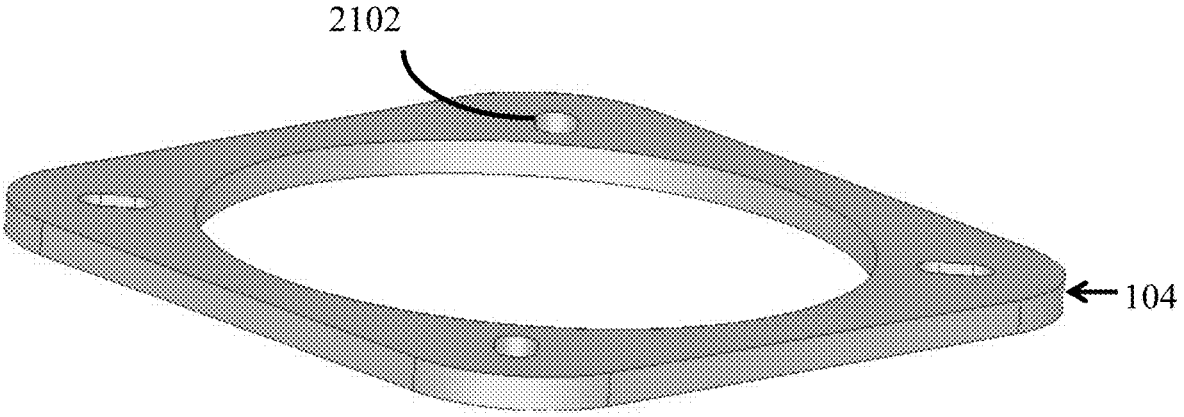
FIG. 34 is a detailed view of a flange in accordance with an embodiment of the present invention.

FIG. 34 provides a detailed view of a flange 104 in accordance with an embodiment of the present invention. As shown, the flange 104 includes a plurality of openings, permitting the flange 104 to be easily attached to a base plate 202.

Figure 35A:
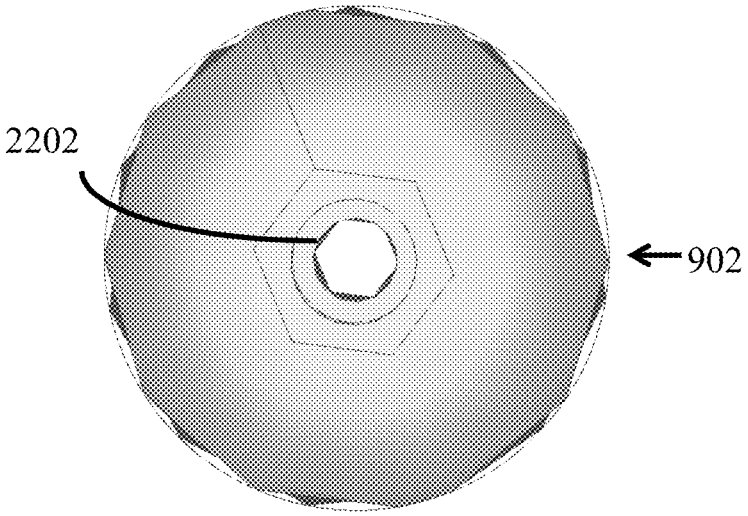
FIGS. 35*a* and 35*b* are detailed views of a bumper in accordance with an embodiment of the present invention.
Figure 35B:
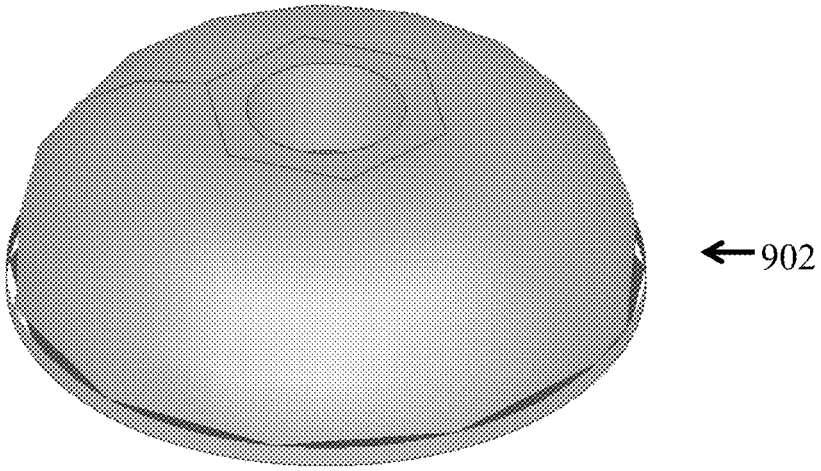

FIGS. 35*a* and 35*b* provide detailed views of a bumper 902 in accordance with an embodiment of the present invention. As shown, the bumper 902 includes an opening 2202 so as to be mounted to the frame 300. The bumper 902 may be attached using a bolt or other connector.

It is understood that the preceding is merely a detailed description of some examples and embodiments of the present invention and that numerous changes to the disclosed embodiments may be made in accordance with the disclosure made herein without departing from the spirit or scope of the invention. The preceding description, therefore, is not meant to limit the scope of the invention but to provide sufficient disclosure to allow one of ordinary skill in the art to practice the invention without undue burden.

What is claimed is:

1. A small cell pole system comprising:

a base fixed to a ground location, the base enclosing a capsule, wherein the capsule comprises:

a backplane with a vertical slot;

a front bar with a hole opposite the backplane; and a communication component mounted to a card with a front protrusion and a back protrusion, wherein the back protrusion is inserted in the vertical slot and the front protrusion is inserted in the hole; and a pole connected to the base in a nested configuration, wherein said pole comprises a plurality of elongated sections comprising at least a lower section connected to the base and an upper section, wherein the plurality of elongated sections are configured to extend to an adjustable height by moving one or more of the plurality of elongated sections in an axial direction relative to the base by exerting an axial force against the upper elongated section in a direction away from the ground location, wherein the upper section is fixed relative to the base by a cam-lock assembly once the axial force is removed.

2. The system of claim 1, wherein the upper section of the plurality of elongated sections has a diameter less than a diameter of the lower section of the plurality of elongated sections.

3. The system of claim 2, wherein the plurality of elongated sections further comprises a middle section with a diameter greater than the diameter of the upper elongated section and less than the diameter of the lower elongated section.

4. The system of claim 1, further comprising an antenna assembly mounted to the pole opposite the base, wherein the antenna assembly is operatively connected to the communication component.

5. The system of claim 4, wherein the antenna assembly is connected to the upper section of the plurality of elongated sections via a transition portion comprising a removable vent cover.

6. The system of claim 1, wherein a plurality of cards each containing a respective one of a plurality of communication components are mounted in the capsule.

7. The system of claim 1, wherein the cam-lock assembly further comprises a cam and the upper section of the plurality of elongated sections further comprises a gripping surface;

wherein the cam is configured to engage with the gripping surface and secure the upper section in place and prevent the upper section from moving in an axial direction towards the ground location.

8. The system of claim 1, wherein the lower section of the plurality of elongated sections further comprises a bumper located on an interior surface of the lower section proximate an upper end of the lower section that is axially opposite the ground surface;

wherein the upper section of the plurality of elongated sections further comprises a ring located on an exterior surface of the upper section proximate a lower end of the upper section; and wherein the bumper is configured to contact the ring as the upper section is moved away from the ground surface to prevent the upper section from being completely removed from the lower section.

9. The system of claim 1, wherein the base comprises an opening and the lower section further comprises a removable panel proximate the opening permitting access to the capsule.

10. The system of claim 1, wherein the base is connected to an embedded section located below the ground location.

11. The system of claim 10, wherein the embedded section further comprises an access point and wherein an electrical line passes through the access point and is configured to operatively connect the communication component to an external device.

12. The system of claim 10, wherein the external device comprises a power source and the electrical line connects to the communication component via a ground terminal located proximate the backplane and an active terminal located proximate the front bar.

13. A method of installing a small cell pole system, the method comprising the steps of:

fixing a base to a ground location;

inserting a capsule comprising one or more communications components attached to a rigid shell into the base; and connecting a pole to the base in a nested configuration wherein said pole comprises a plurality of elongated sections configured to extend to an adjustable height by moving one or more of the plurality of elongated sections in an axial direction relative to the ground location by exerting an axial force against an upper section of the plurality of elongated sections in a direction away from the ground location, wherein the plurality of elongated sections are fixed relative to one another by a cam-lock assembly when the axial force is removed.

14. The method of claim 13, wherein the method further comprises the steps of connecting an antenna assembly to the pole opposite the base and operatively connecting the antenna assembly to the communication component.

15. The method of claim 13, wherein the cam-lock assembly further comprises a cam connected to the exterior surface of a lower section of the plurality of elongated sections and the upper section further comprises a gripping surface and wherein the cam is configured to engage with the gripping surface and secure the upper elongated section in place and prevent the upper elongated section from moving in an axial direction towards the ground location, the method further comprising the step of removing the axial force once the upper elongated section reaches a desired height.

16. The method of claim 15, wherein the lower section further comprises a bumper located on an interior surface of the lower section proximate an upper end of the lower section that is axially opposite the ground surface and wherein the upper section further comprises a ring located on an exterior surface of the upper section proximate a lower end of the upper section, the method further comprising the step of:

moving the plurality of elongated sections in the axial direction away from the ground surface until the bumper contacts the ring and prevents further movement of the elongated sections in the axial direction away from the ground location.

17. The method of claim 13, the method further comprising the steps of installing an embedded section below the ground location and connecting the embedded section to the base.

18. The method of claim 17, wherein the embedded section further comprises an access point, the method further comprising the step of running an electrical line through the access point to connect an external device to the communication component.

* * * * *